US009453323B2

(12) United States Patent
Valdez Hernandez

(10) Patent No.: US 9,453,323 B2
(45) Date of Patent: Sep. 27, 2016

(54) SCRAPER INCLUDING A DUAL DISCHARGE MECHANISM COMPRISING A PIVOTING TRAY AND AN EJECTOR

(76) Inventor: Jose Leoncio Valdez Hernandez, Aguascalientes (MX)

( * ) Notice: Subject to any disclaimer, the term of this patent is extended or adjusted under 35 U.S.C. 154(b) by 93 days.

(21) Appl. No.: 14/126,257

(22) PCT Filed: Jun. 14, 2011

(86) PCT No.: PCT/MX2011/000075

§ 371 (c)(1),
(2), (4) Date: Jan. 21, 2014

(87) PCT Pub. No.: WO2012/173463

PCT Pub. Date: Dec. 20, 2012

(65) Prior Publication Data

US 2014/0124226 A1 May 8, 2014

(51) Int. Cl.

| | |
|---|---|
| ***E02F 3/64*** | (2006.01) |
| ***E02F 3/65*** | (2006.01) |
| ***E02F 9/00*** | (2006.01) |

(52) U.S. Cl.

CPC ..... *E02F 3/6481* (2013.01); *E02F 3/6472* (2013.01); *E02F 3/652* (2013.01); *E02F 3/653* (2013.01); *E02F 3/654* (2013.01); *E02F 3/656* (2013.01); *E02F 3/657* (2013.01); *E02F 9/006* (2013.01)

(58) Field of Classification Search

CPC ..... E02F 3/6463–3/6481; E02F 3/654; E02F 3/656

USPC ..... 172/624.5, 799.5

See application file for complete search history.

(56) References Cited

U.S. PATENT DOCUMENTS

| | | | | | |
|---|---|---|---|---|---|
| 2,280,439 | A * | 4/1942 | McLean | E02F 3/6418 | 37/424 |
| 2,399,838 | A * | 5/1946 | Vaughn | E02F 3/6481 | 37/412 |
| 3,154,868 | A * | 11/1964 | Buchli | E02F 3/6463 | 298/11 |
| 3,316,822 | A * | 5/1967 | Seauan | E01C 19/27 | 37/404 |
| 3,418,735 | A * | 12/1968 | Martin | E02F 3/6481 | 37/431 |

(Continued)

*Primary Examiner* — Matthew D Troutman

(74) *Attorney, Agent, or Firm* — Hoglund & Pamias, PSC; Roberto J. Rios

(57) ABSTRACT

A scraper with dual downloading mechanism having a container enclosing a hinged gate, a hinged box and an ejector located inside said hinged box. A plurality of piston arrangements is provided to selectively lower and raise the container and to selectively load/unload a material from said container by a hinged box and an ejector.

23 Claims, 27 Drawing Sheets

(56) References Cited

U.S. PATENT DOCUMENTS 3,475,840 A * 11/1969 Williams ..... E02F 3/64 37/417
3,574,960 A * 4/1971 Peterson ..... E02F 3/657 37/421
3,584,405 A * 6/1971 Mazzarins ..... E02F 3/64 37/417
3,633,679 A * 1/1972 Dahlberg ..... A01B 63/22 172/123
3,889,404 A * 6/1975 Eftefield ..... E02F 3/657 37/430
4,299,290 A * 11/1981 Nunes, Jr. ..... E02F 3/847 172/4.5
4,353,175 A * 10/1982 Gurries ..... E02F 3/3483 172/40
4,632,192 A * 12/1986 Hooks ..... A01B 45/04 172/125
5,839,212 A * 11/1998 Brinker ..... E02F 3/407 172/684.5
6,041,528 A * 3/2000 Broach ..... E02F 3/6481 37/416
6,092,316 A * 7/2000 Brinker ..... E02F 3/407 37/416
6,125,561 A * 10/2000 Shull ..... E02F 3/651 172/2
6,910,289 B2 * 6/2005 Moyna ..... E02F 3/6481 172/815
7,117,953 B2 * 10/2006 Moyna ..... E02F 3/6481 172/272
7,356,949 B2 * 4/2008 Moyna ..... E02F 3/6481 172/815
7,367,408 B2 * 5/2008 Moyna ..... E02F 3/6481 172/684.5
7,640,996 B2 * 1/2010 Moyna ..... B60B 11/00 172/799.5
7,647,984 B2 * 1/2010 Moyna ..... E02F 3/65 172/799.5
7,673,700 B2 * 3/2010 Moyna ..... E02F 3/65 172/799.5
2002/0078606 A1 * 6/2002 Grummett ..... E02F 3/6481 37/415
2004/0188115 A1 * 9/2004 Moyna ..... E02F 3/6481 172/779
2005/0217044 A1 * 10/2005 Moyna ..... E02F 3/6481 15/100
2006/0123674 A1 * 6/2006 Moyna ..... E02F 3/6481 37/411
2007/0039212 A1 * 2/2007 Moyna ..... E02F 3/6481 37/426
2008/0230244 A1 * 9/2008 Moyna ..... E02F 3/64 172/799.5
2008/0251266 A1 * 10/2008 Moyna ..... E02F 3/6481 172/1
2009/0084002 A1 * 4/2009 Moyna ..... A01B 29/06 37/195
2009/0085328 A1 * 4/2009 Moyna ..... A01B 29/06 280/677
2009/0095496 A1 * 4/2009 Moyna ..... B60B 11/00 172/799.5
2009/0107014 A1 * 4/2009 Moyna ..... E02F 3/652 37/435

* cited by examiner

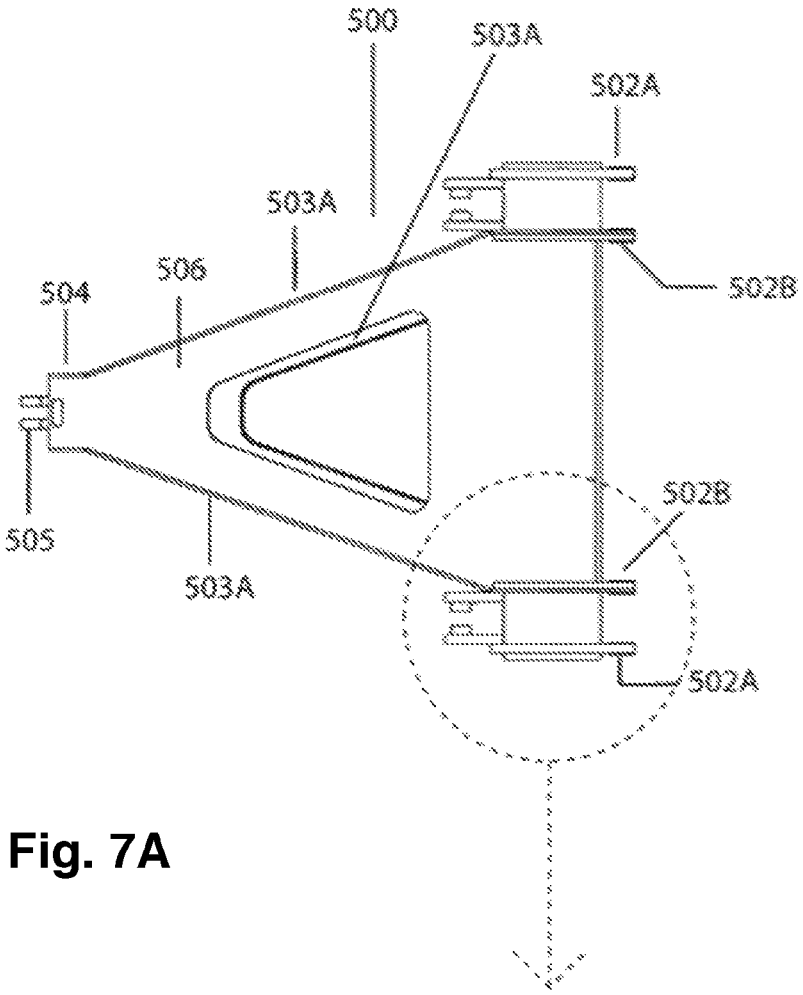
Fig. 7A
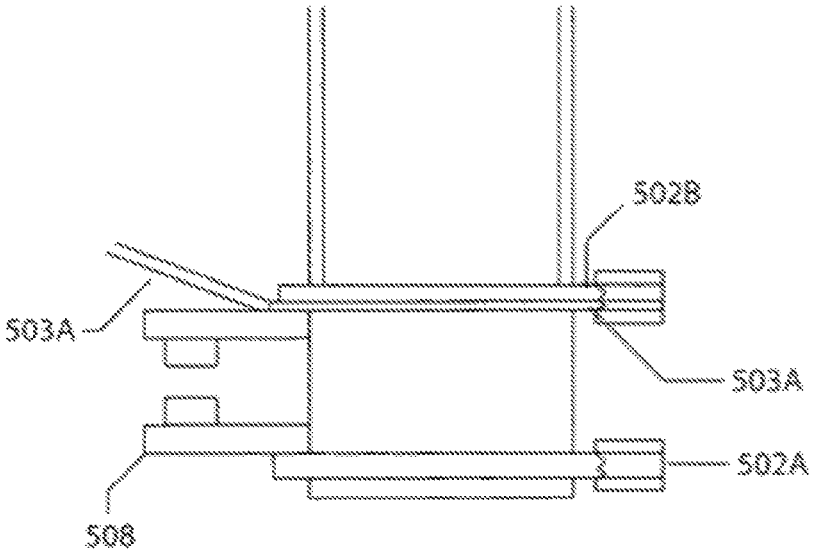

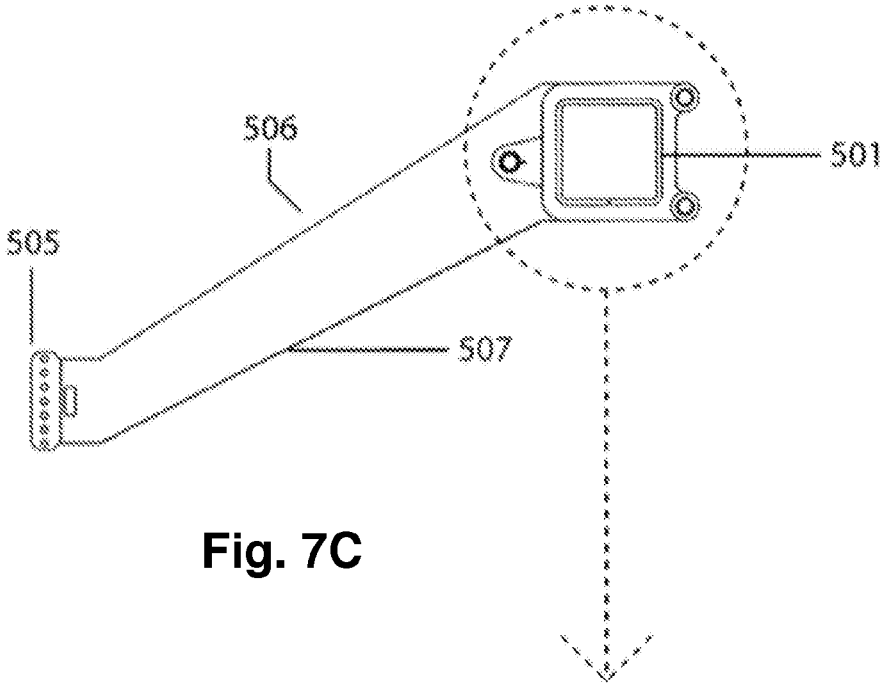
Fig. 7C
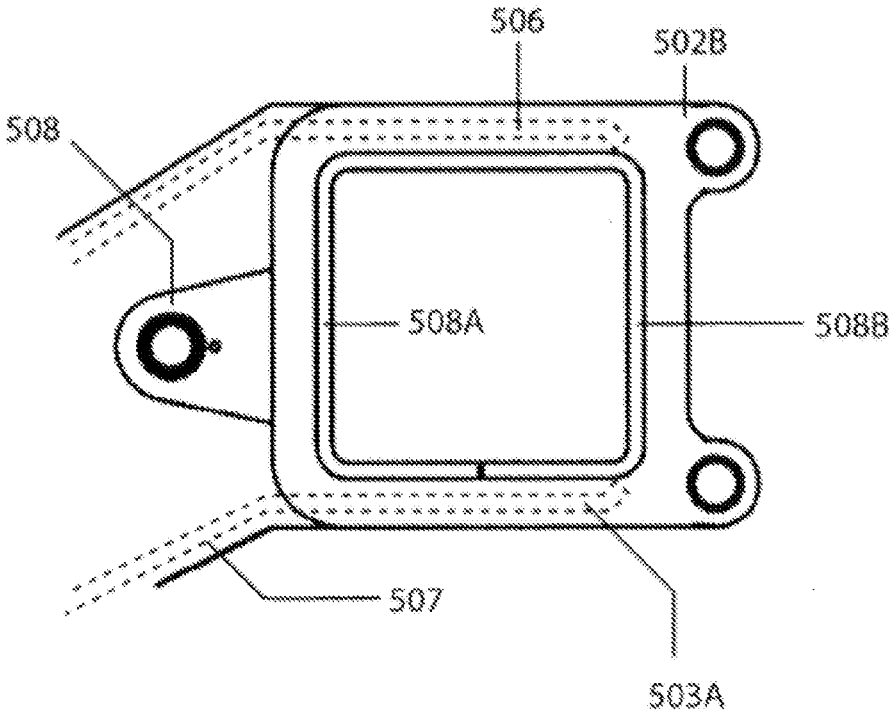

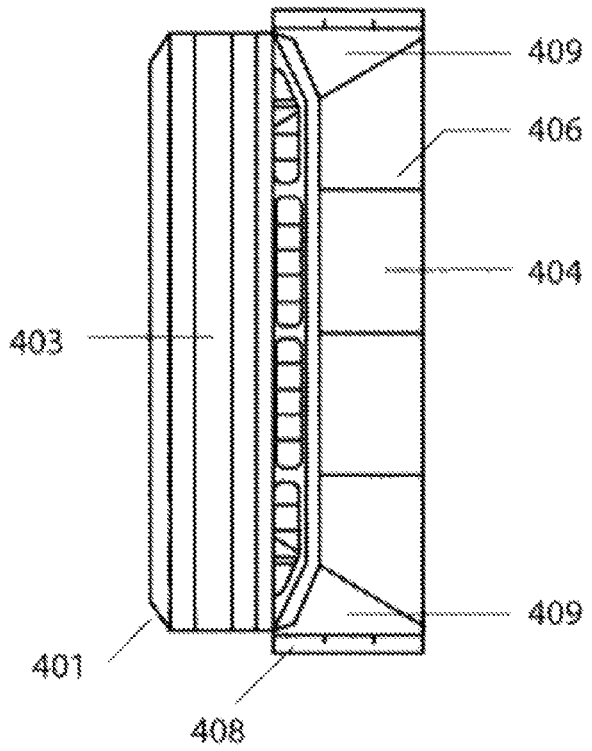
Fig. 12A
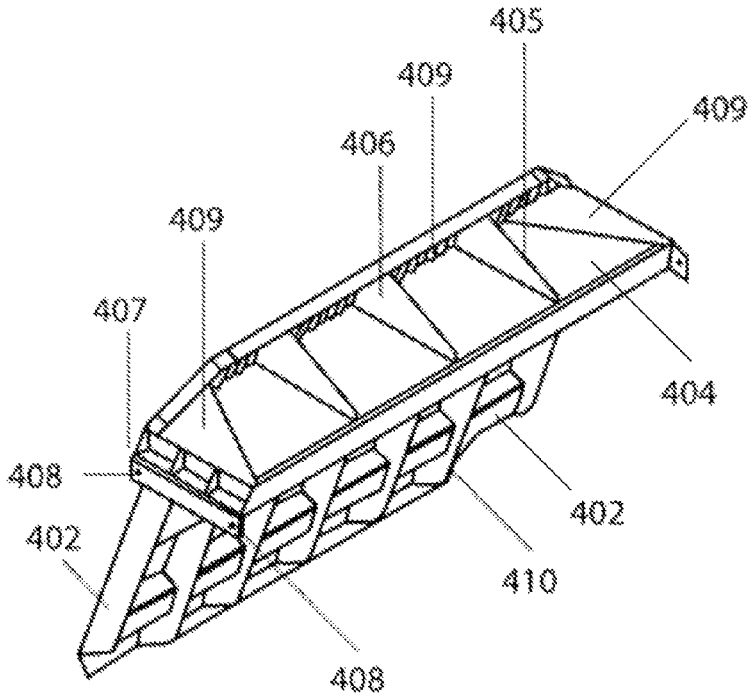

SCRAPER INCLUDING A DUAL DISCHARGE MECHANISM COMPRISING A PIVOTING TRAY AND AN EJECTOR

BACKGROUND OF THE INVENTION

The present invention relates to the industry of moving, hauling and/or carrying land and the like; and more specifically refers to an equipment called scraper which is used for moving land and similar materials such as mud. More specifically refers to a drag scraper, which is pulled by a tractor. Generally, two methods have been used to solve the problem of land unloading, once it is inside the box of the scraper and must be unload. The first method used is a hinged box, this method basically consists in using the box of the scraper as a container or external box hinged through a couple of bolts and a hydraulic cylinder as an element which rotates the scraper box on its pivots, this allows unloading the land through the mouth of the scraper under the action of gravity.

This method has two variants, one in which that the blade is attached directly to the hinged box of the scraper and therefore travels along therewith during the movement of the scraper (in this case the forces generated during the action of loading the scraper, are transmitted to the bolts on which the scraper box will rotate). Another variant of this method consists in fixing the blade to the outer structure of the scraper, which is the same to which the hinging bolts are fixed (in this solution the blade is firmly attached and can transmit the loading action forces to the entire structure of the machine), in this case the box is fixed and pivoted on a hinge, which is located in the frontal-bottom part of the scraper box, so that only the box floor is "lifted" (tilted) with the rotating movement of the box when unloading the land.

The second method used by the manufacturers of scrapers consists basically of a wall that pushes the material from the rear toward the front of the of the box scraper (ejector). Through the use of one or two hydraulic cylinders this wall is moved to the beginning of the mouth for unloading of the scraper where the material falls the ground under the action of gravity.

Most manufacturers of scrapers currently have chosen to provide the market with scrapers consisting of both methods for unloading the material, mainly due to the best features of one or another according to the type and condition of the ground, in which the scraper will work.

Due to the great variability of soil types and conditions in which the scrapers are used for the agricultural and construction industry, both the pivoting box unloading mechanism as well as the ejector mechanism, face problems with the unloading according to the type and conditions of the soil, making even impossible to use the scraper in some soils with any of these unloading methods, forcing the contractors to have in their inventory both hinged box scrapers and ejector scrapers.

The following known patent documents refer to the technical field of the present invention: U.S. Pat. No. 3,176,863 granted to Kuhl; U.S. Pat. No. 3,533,174 granted to Carston; U.S. Pat. No. 4,366,635 granted to Joyce, Jr; U.S. Pat. No. 4,383,380 granted to Miskin; U.S. Pat. No. 4,388,769 granted to Miskin; U.S. Pat. No. 4,398,363 granted to Miskin; U.S. Pat. No. 4,553,608 granted to Miskin; U.S. Pat. No. 5,702,227 granted to Berg; U.S. Pat. No. 6,092,316 granted to Brinker; U.S. Pat. No. 6,347,670 granted to Miskin; U.S. Pat. No. 7,707,754 granted to Congdon.

Of these documents, U.S. Pat. Nos. 6,092,316 and 6,347,670 are considered to be the closest prior art. However, these inventions differ from the currently described invention at least for the following reasons. With regards to the lifting mechanism, U.S. Pat. No. 6,092,316 discloses a mechanism of four rear bars resting on the rear wheels, so that when it is actuated, the scraper tilts forward, as shown in FIG. 1 thereof, U.S. Pat. No. 6,347,670 discloses a four rear bars also resting on the rear wheels, so that when it is actuated, the scraper tilts forward, as can be appreciated in FIG. 8. The present application relates to a system that has a frontal parallelogram mechanism and a rear parallelogram mechanism, driven by hydraulic cylinders, which are supported on the front pull and the rear wheels, respectively, allowing the scraper to be raised horizontally so that the cutting blade maintains the same angle throughout the entire travel.

With regards to the ejector, U.S. Pat. No. 6,092,316 is a four-bar mechanism actuated by hydraulic cylinders, which actuates the ejector. The ejector is attached to the structure of the machine by means of links as shown in the FIG. 4. U.S. Pat. No. 6,347,670 fails to describe an ejector. In the present invention, the ejector is contained inside a hinged box, so that when the hinged box is moved to unload the material, the ejector travels with the box. The ejector moves inside the box, actuated by hydraulic cylinders. The ejector is supported by means of wheels and respective rails.

The hinged box in U.S. Pat. No. 6,092,316 is not existent. In U.S. Pat. No. 6,347,670, the box is driven by a tilted cylinder, as shown in the figures, at approximately 45 degrees in a loading position (cylinder fully closed, staying vertically in the unload position (cylinder fully open)). See FIG. 6 of the patent. In the case of the present application, the hinged box rotates together with the ejector since the latter is located inside of the box. The hinged box has its turning point in the hinge that is located in the floor near the cutting blade, and is rotated by two cylinders. One end of the cylinder is attached to the structure of the scraper, while the other end of the cylinder is attached to the top frontal part of the hinged box.

The gate of the patent 316 consists of a link that has a pivot point (58), wherein one end of the cylinder that actuates the link unites at its intermediate approximate distance. The gate is placed is semicircular form at the tip of the link. The other end of the cylinder is attached to the structure of the scraper. When the cylinder is closed, the gate is open and vice versa. In this case, the cylinder is located in the back of the gate. The system of patent 670, is very similar to the above, the difference lies in the fact that the actuating cylinder is located on the frontal part of the gate. The basic difference with both patents lies in that the hinged gate of the present invention comprises three sections that fold down the length of the actuating piston and are hinged.

In the prior art scrapers, the cutting blade is linked to the hinged box and this represents a problem because when the hinged box tilts, it varies the approaching angle modifying thus, the efficiency of the material cut.

When the land is difficult and the scraper gets stuck, something that is quite frequent in this field, the pushing or pulling point on the same varies depending on the position of for example the hinged box, being difficult to be pushed or pulled with for example, another tractor. This represents a further disadvantage in the scrapers of the prior art known until the present invention.

OBJECTS OF THE INVENTION

Considering the background above and the inconveniences of the prior art, it is an object of the present invention to provide a scraper comprising an unloading mechanism by means of a hinged box and another unloading mechanism by means of an ejector, with which the scraper will be able to work independently of the type and condition of the soil, making it more efficient and avoid using two different machines to carry out the work.

Another object of the invention is to obtain an invariable optimum cutting angle.

In addition, another object of the invention is to provide a scraper whose main cutting blade is not coupled to the hinged box but to the external container or box.

An additional object is to provide a pushing or bearing point in the scraper whose height remains constant regardless of the position of the box.

A further object of the present invention is to provide a pulling, articulated mechanism, with a movement in three rotations, which allows it to adapt to the changes of position that occur during the operation of the scraper itself.

These and other objects will become apparent from the following description and accompanying figures. Equal reference numerals designate equal components in the different figures shown.

BRIEF DESCRIPTION OF THE DRAWINGS

FIGS. 7A to 7D show: a detailed top view of the pull, the front top perspective view, a detailed elevation side view, and finally a frontal elevation view, respectively.

FIGS. 12A to 12D show a top view, a top rear perspective view, an elevated side view and an elevated rear view, respectively of the ejector.

DETAILED DESCRIPTION OF THE INVENTION

Before starting the detailed description of the invention, it should be noted that the construction is symmetrical, i.e., that is if the scraper is divided about its longitudinal axis, the elements that are on one side, are also on the other side.

Figure 1:
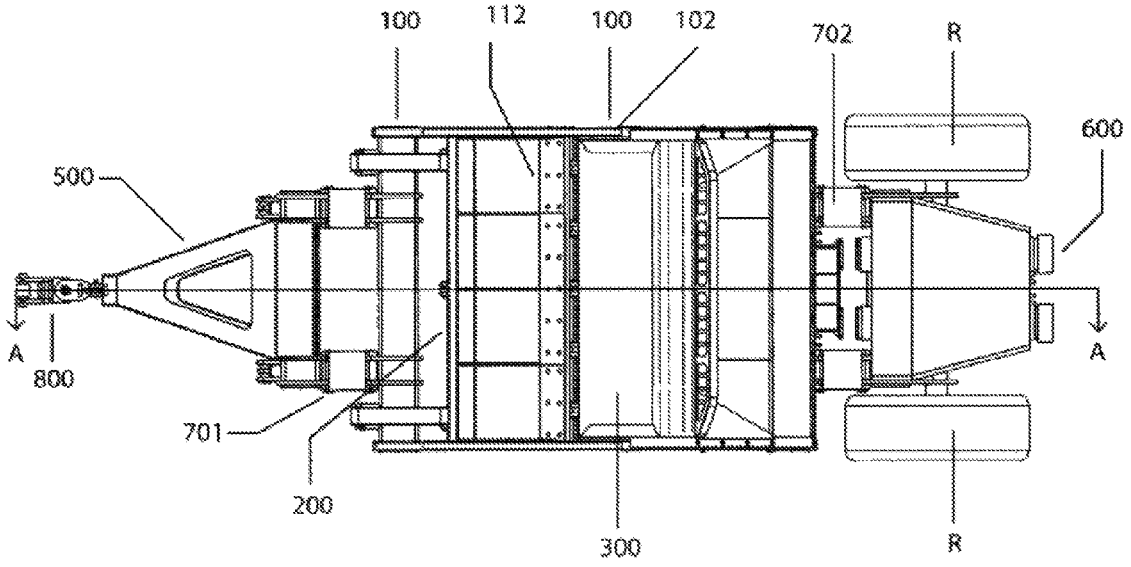
FIG. 1 is a top view of the of double scraper mechanism system.
Figure 2:
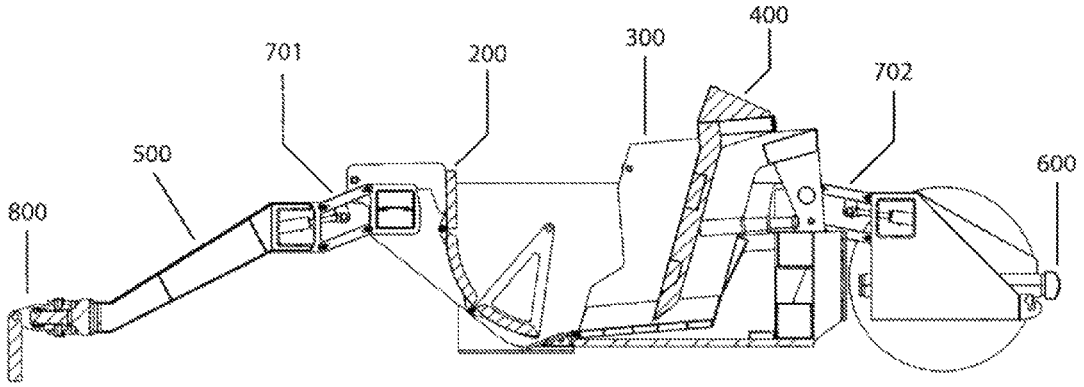
FIG. 2 shows a cross section of the dual-mechanism scraper taken along the line A-A in FIG. 1.

As can be seen from the attached figures, and particularly in FIG. 1, the scraper generally includes a frontal part, a middle part and a back part and in particular:

A container or external box (100);

A hinged box (300) (see FIG. 2);

An ejector (400);

A pull arm (500);

A wheel support with push element (600) (see FIG. 1);

Two parallelogram systems frontal and rear (701 and 702), respectively; and An articulated element (800) that attaches the scraper to the tractor or in tandem to another scraper.

The container (100) holds in its interior, among other elements, a folding gate (200), a hinged box (300) and the ejector (400). The pull arm (500) is attached to the frontal part of the container or external box; the wheel support with push element (600) is placed on its back part.

The parallelogram system (701) joins the pulling arm (500) with the container (100), while the parallelogram system (702) joins the wheel support (600) with the same container (100). The pulling arm (500) is attached to the articulated element (800) by means of a series of bolts or screws.

Figure 5:
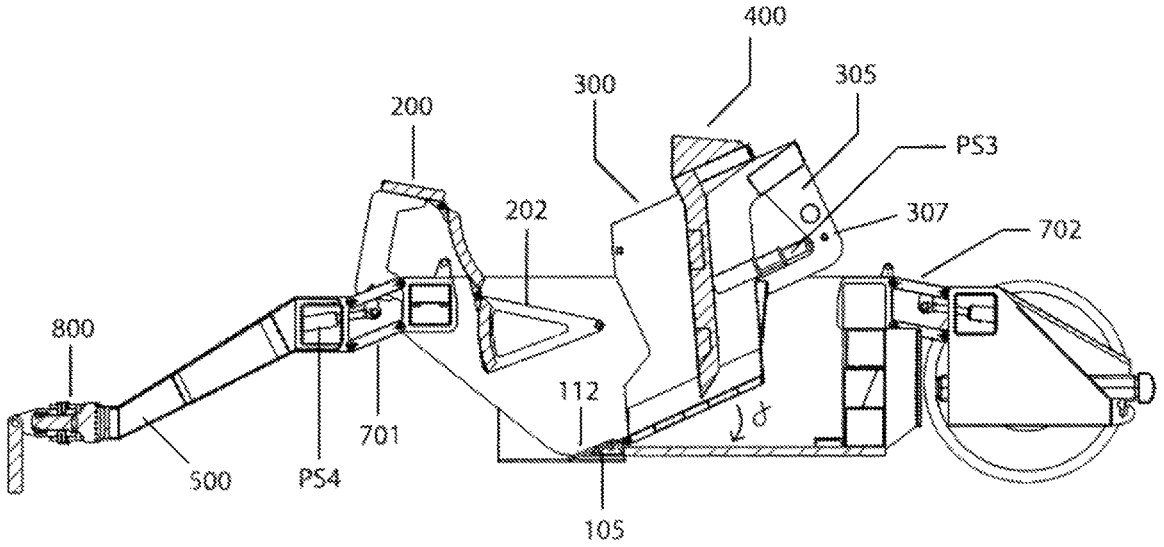
FIG. 5 shows a cross section of the system in the position shown in FIG. 4, taken along the length of the cut A-A in FIG. 1.

The container or external box (100) comprises two parallel sidewalls (101) (see FIG. 6) that in its top frontal part are joined with a tubular square (102). A support plate (104) is located at the opposite lower end joining both walls (101). At the same end but at the top the support of the push element (106) is located joined to the walls (101) through the tubular elements (103). In the frontal bottom end (see FIGS. 6A-6D), support (105) of the blade (112) (see FIG. 5) finally merges the walls (101) between themselves. In order to support the parallelograms (702), the thrust supports are placed (117).

A reticulated floor (107) is joined to the plate (104), to the walls (101) and to the support (105) of the blade (112). This floor is comprised by a mesh of solepieces and serves to support the weight of the hinged box and be part of the structure of the scraper.

The tubular profile (102), which is located in the top frontal part of the container, includes three groups of support bearings (108), (109) and (110), all of them placed generally perpendicular to the profile. The group (108) is used as support for the opening of the hinged gate (200), the group (109) serves as a point of support to raise the container horizontally, and the group (110) serves as support for the piston (PS1) (see FIG. 6E) that will trigger the motion of the hinged gate. This movement is achieved when the piston (PS1) is actuated, which moves the plates (110') by moving around the group of supports (108). As can be seen in this FIG. 6E, one end of the piston (PS1) is connected to the supporting group (110) and the other to the plates (110') through rotating bolts.

In general terms, the structural elements are manufactured with steel plates and, when applicable, with reinforcement bushings of a suitable material, as is well known in the art, such as bronze or the use of bearings.

Returning to FIGS. 6A to 6F, the supporting plate (104), also serves as support for the push element (106) that is configured and dimensioned to withstand the application of a force sufficient to push the loaded scraper. This push element (106) is attached to the tubular elements (103) by means of a series of plates, which in turn are joined to the side walls (101). The tubular profile elements have a purpose of reinforcement although any structural element with the sufficient mechanical strength to perform the work can be used.

Figure 6A:
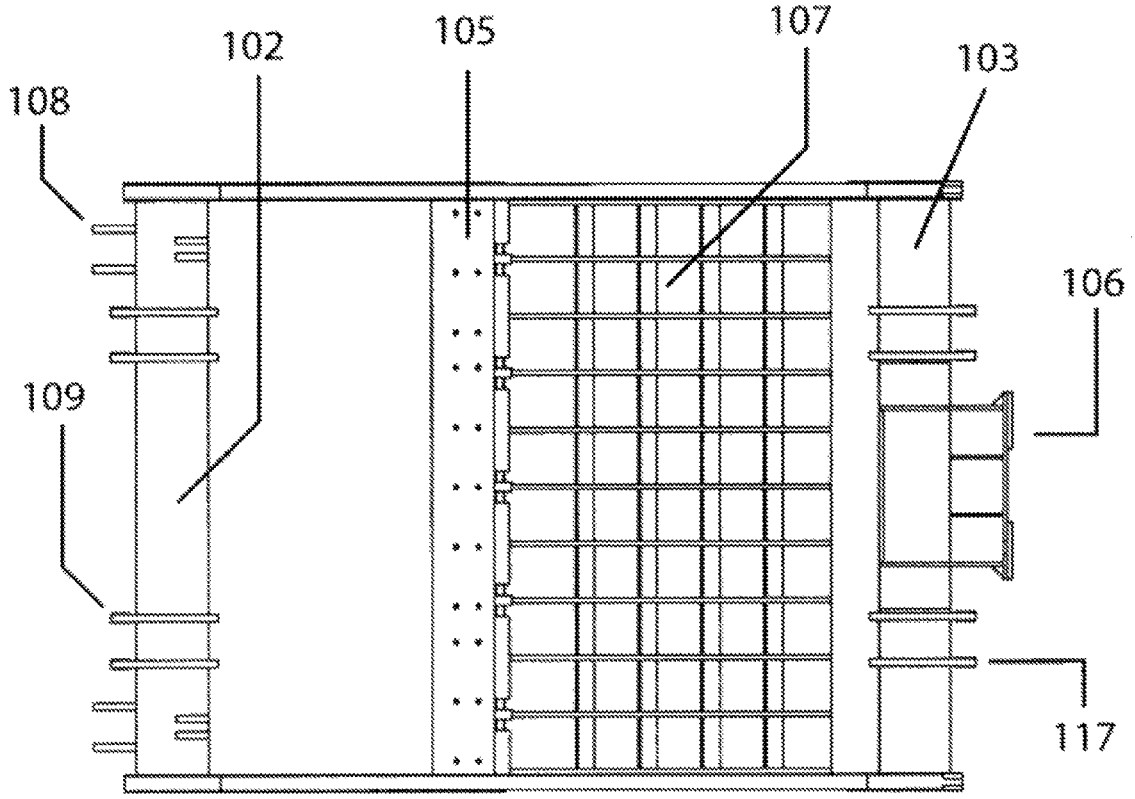
FIGS. 6A, 6B, 6C and 6D show a top view, a top and back isometric view, a left back side view and a back view of the container or external box.
Figure 6B:
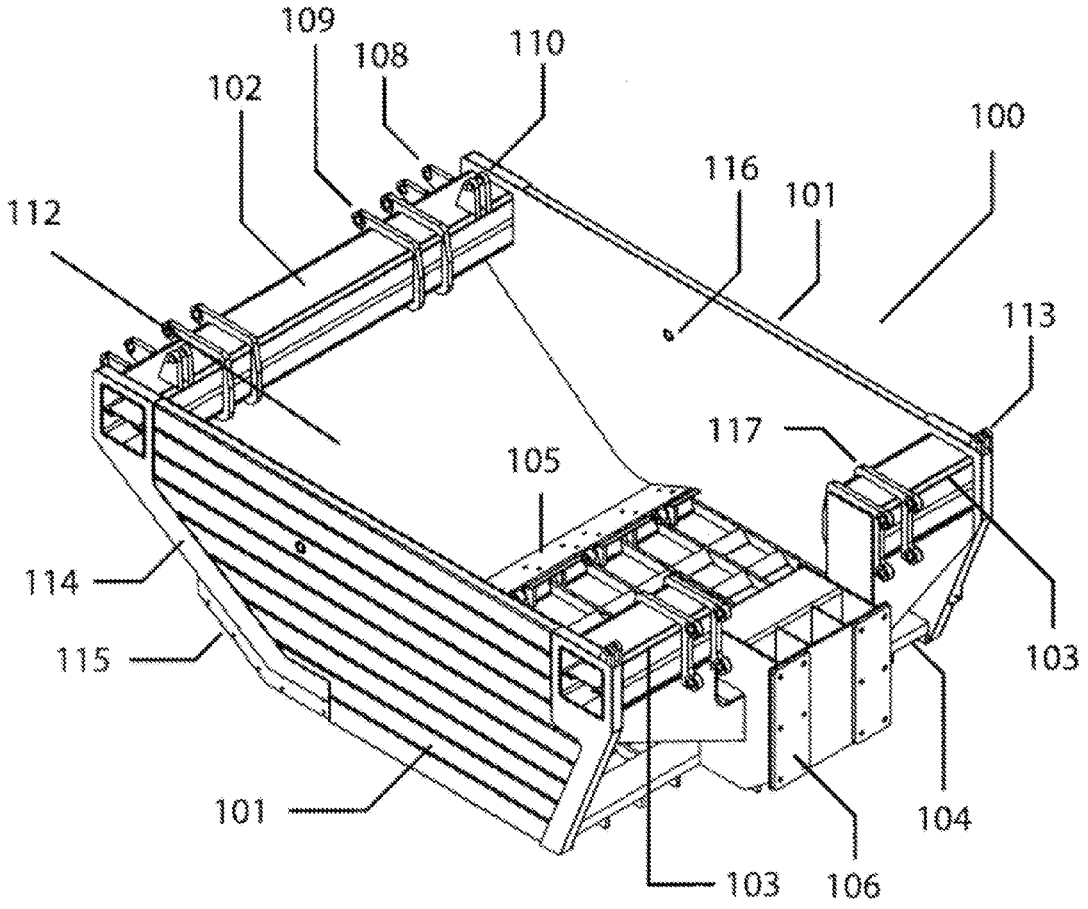
Figure 6C:
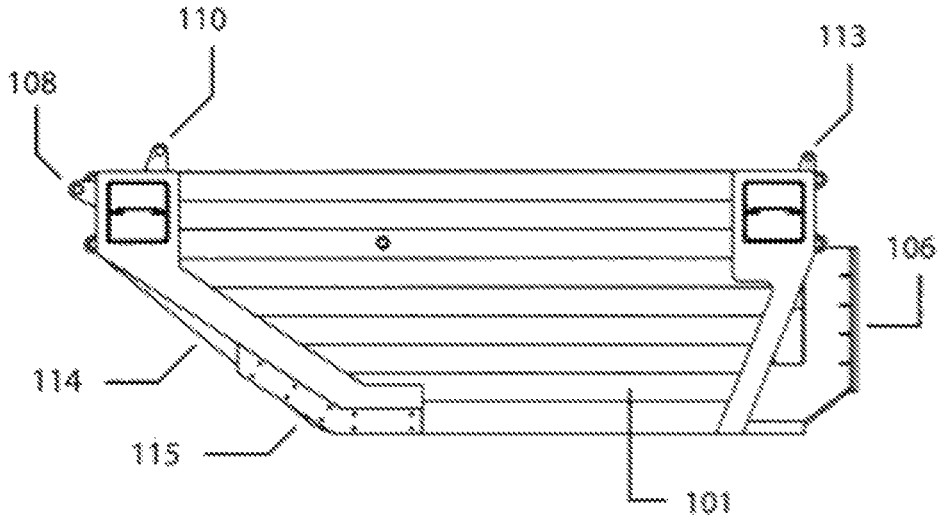
Figure 6D:
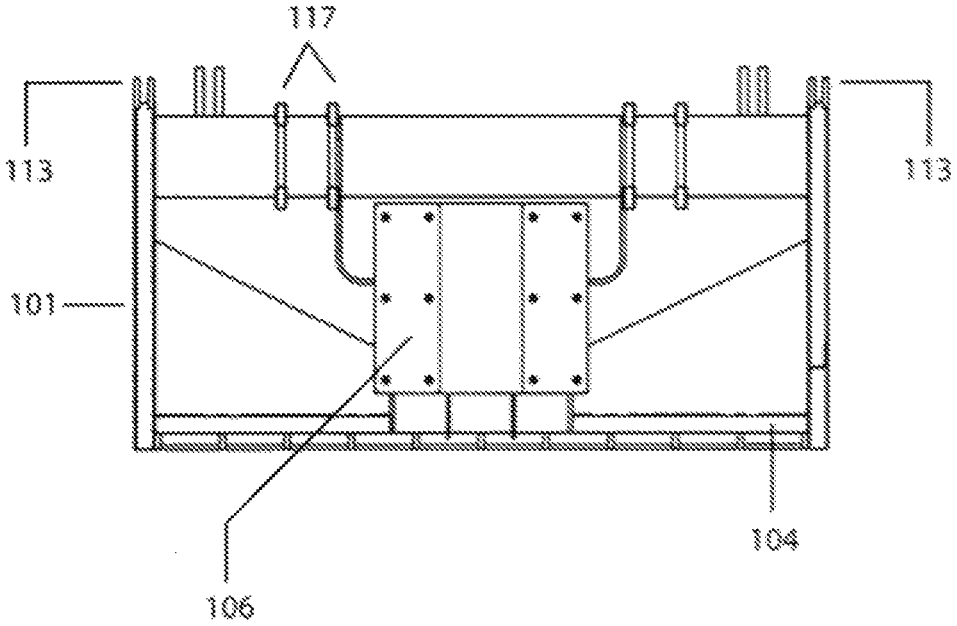
Figure 6E:
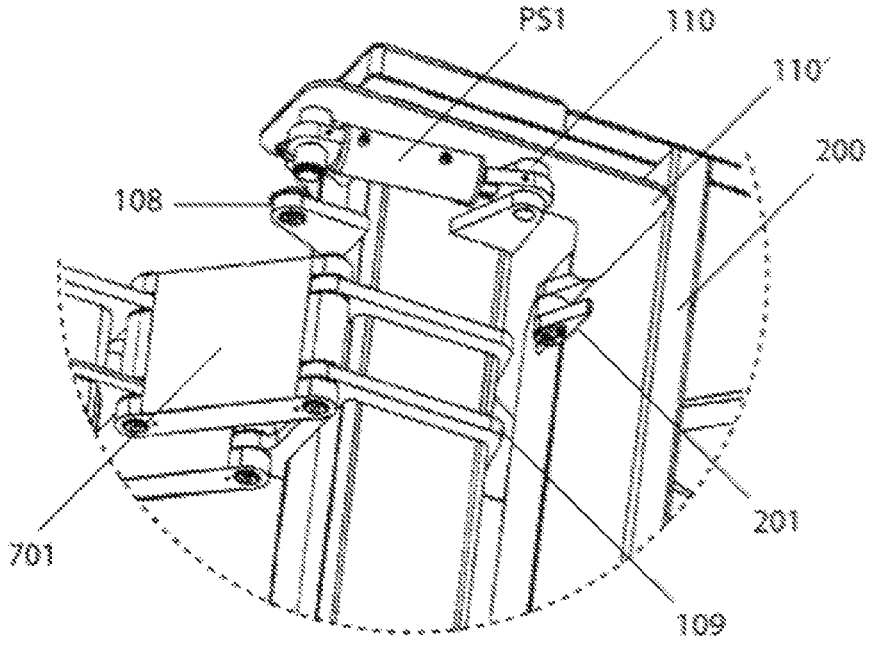
FIG. 6E shows a detail of the support groups for 108-110.
Figure 6F:
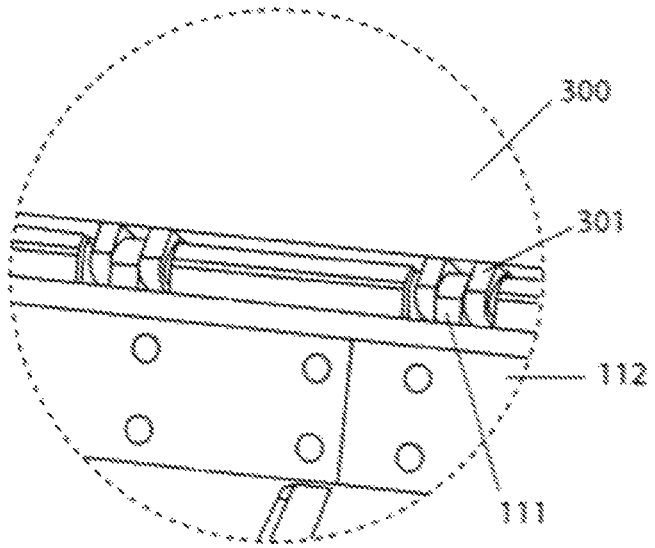
FIG. 6F shows a detail of the hinged box support area.
Figure 7B:
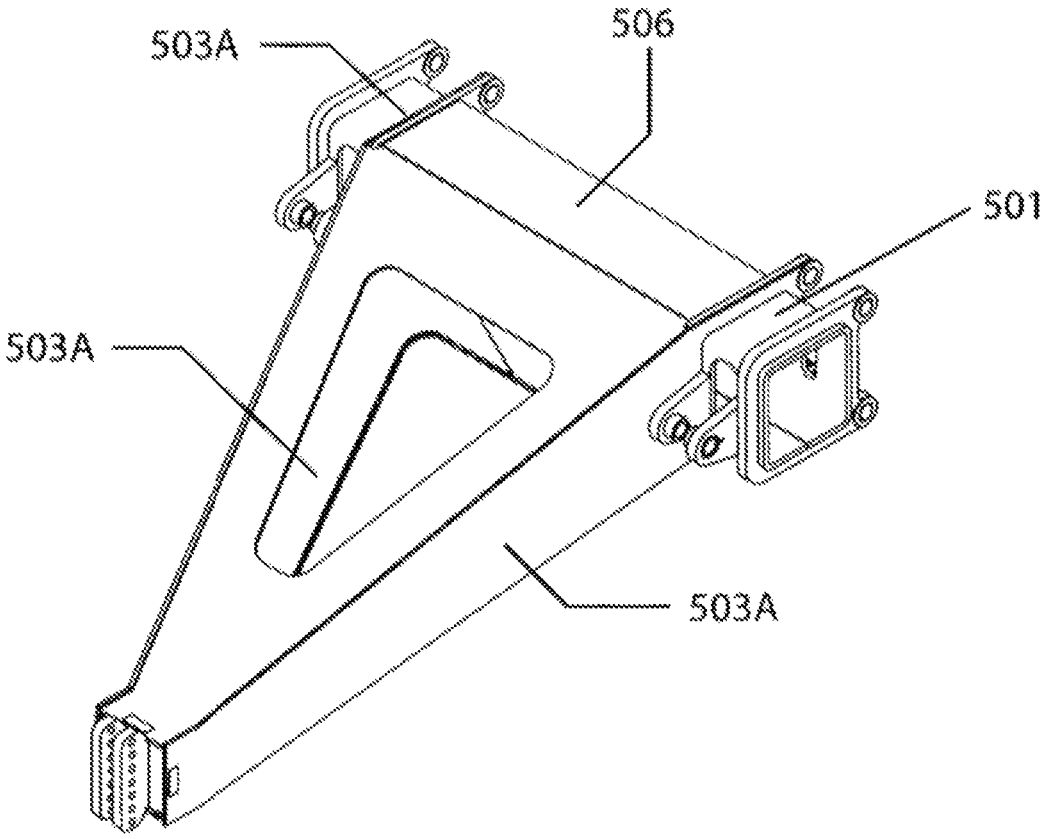
Figure 7D:
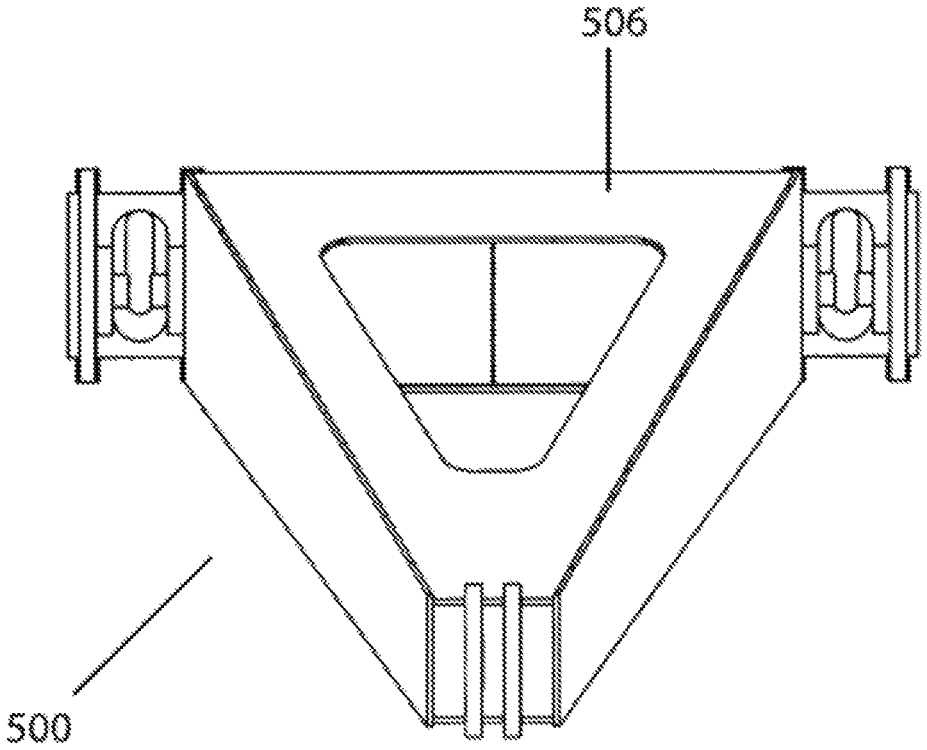

Mechanical elements formed by pivoting bushings (111) (see FIG. 6B) are joined to the support (105) of the blade (112); these pivoting bushings work in conjunction with corresponding bushings (301) of the hinged box (300) (see FIG. 6F). A metal bar is introduced through these pivoting bushings (111, 301), to perform the swing movement. To place the blade (112) on its support (105) a series of corresponding threaded holes are used.

Figure 3:
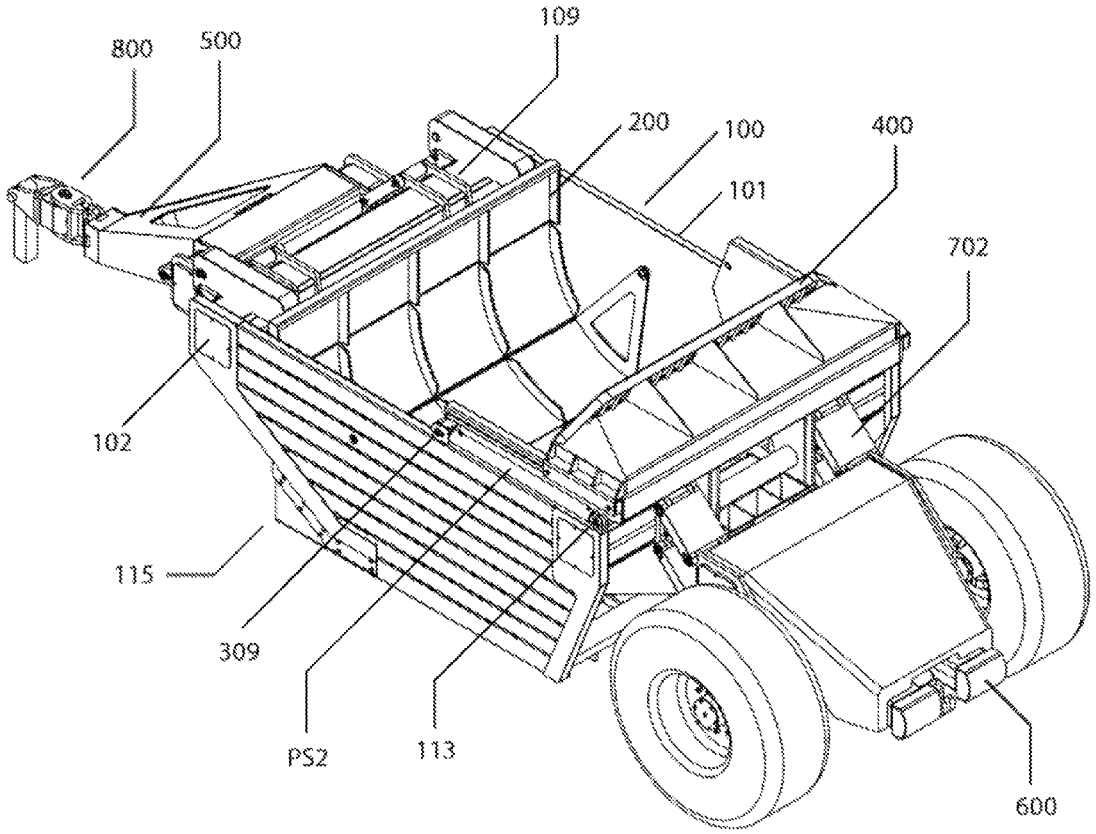
FIG. 3 shows a perspective top and back view of the scraper with the pivoting box closed.

A pair of support elements (113) is found in the top and the rear edge of each of the sidewalls (101) that will serve as a point of support for a piston (PS2) (see FIG. 3) that will tilt the hinged box.

The plate (114) follows the slanted contours of each of the plates that make up the walls (101), and separably bears, side blades (115), which work in conjunction with the blade (101) to break the land.

Figure 10:
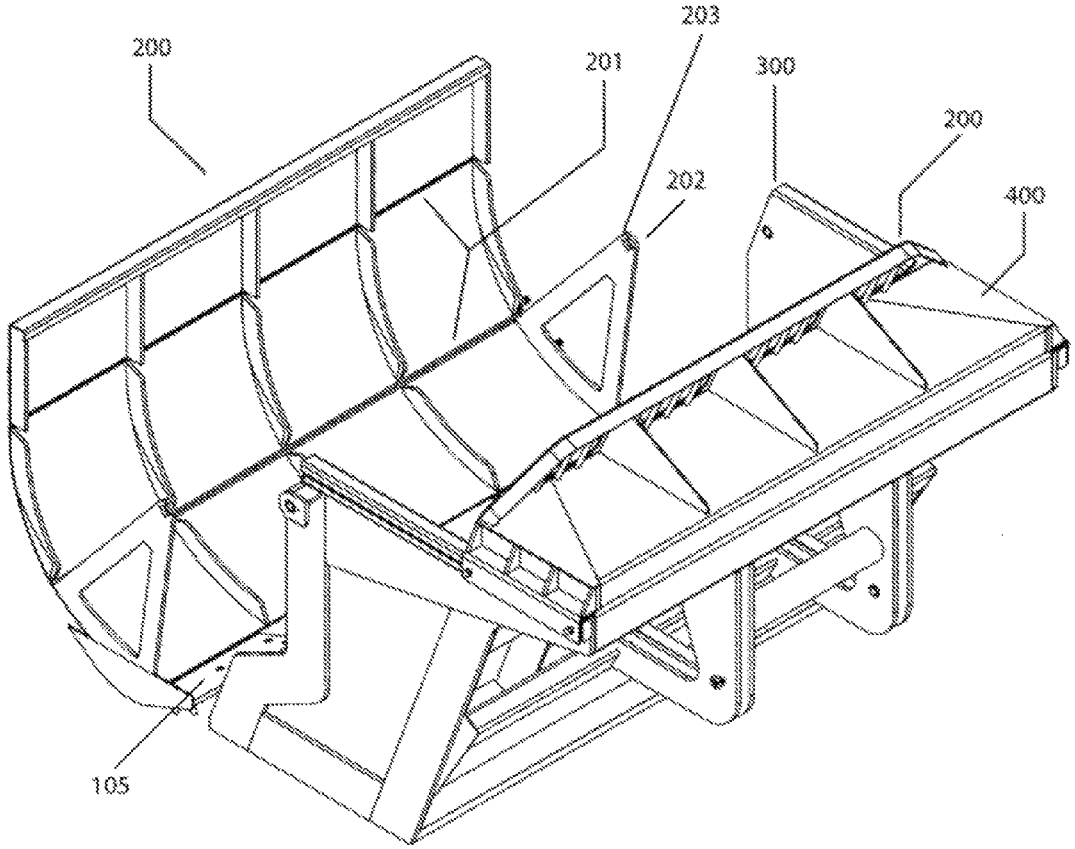
FIG. 10 shows the folding gate, the hinged box and the ejector.
Figure 11A:
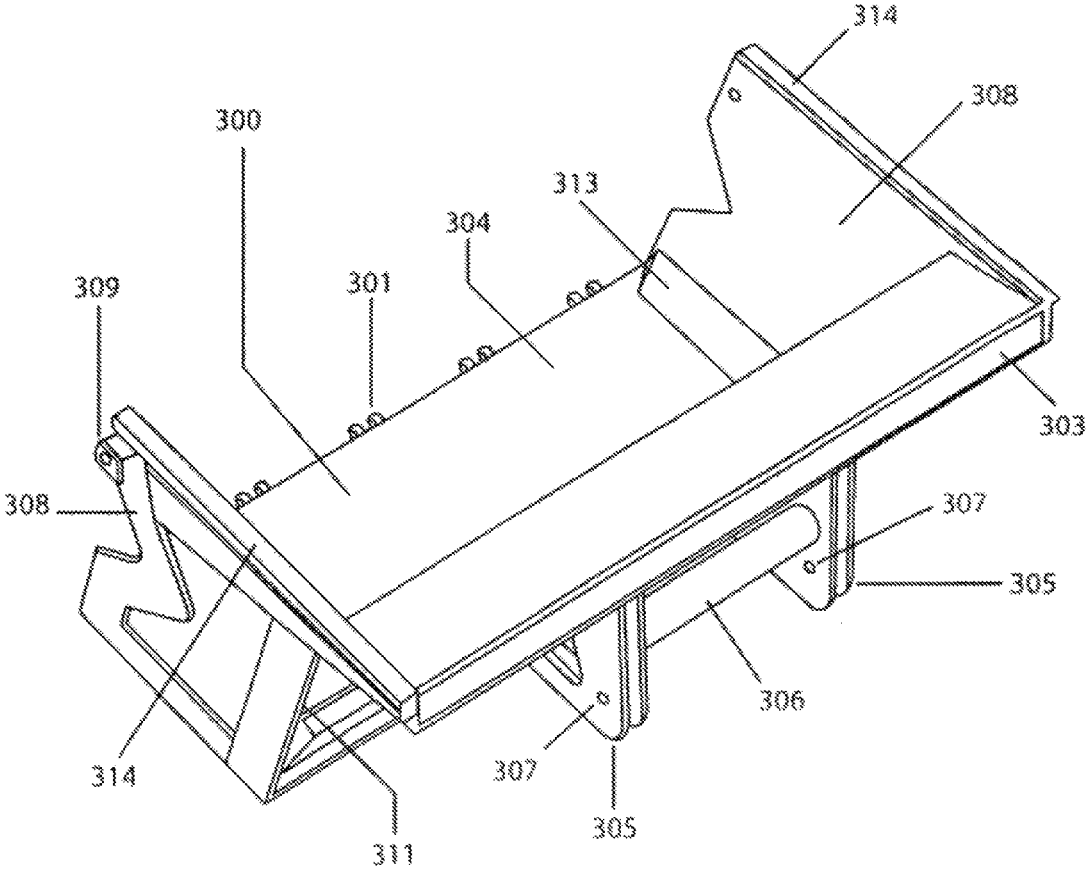
FIGS. 11A to 11D shows a rear top perspective view, an elevated side view, a top frontal right side perspective view, and a cut-away view taken along the line A-A in FIG. 1, respectively of the hinged box.
Figure 11B:
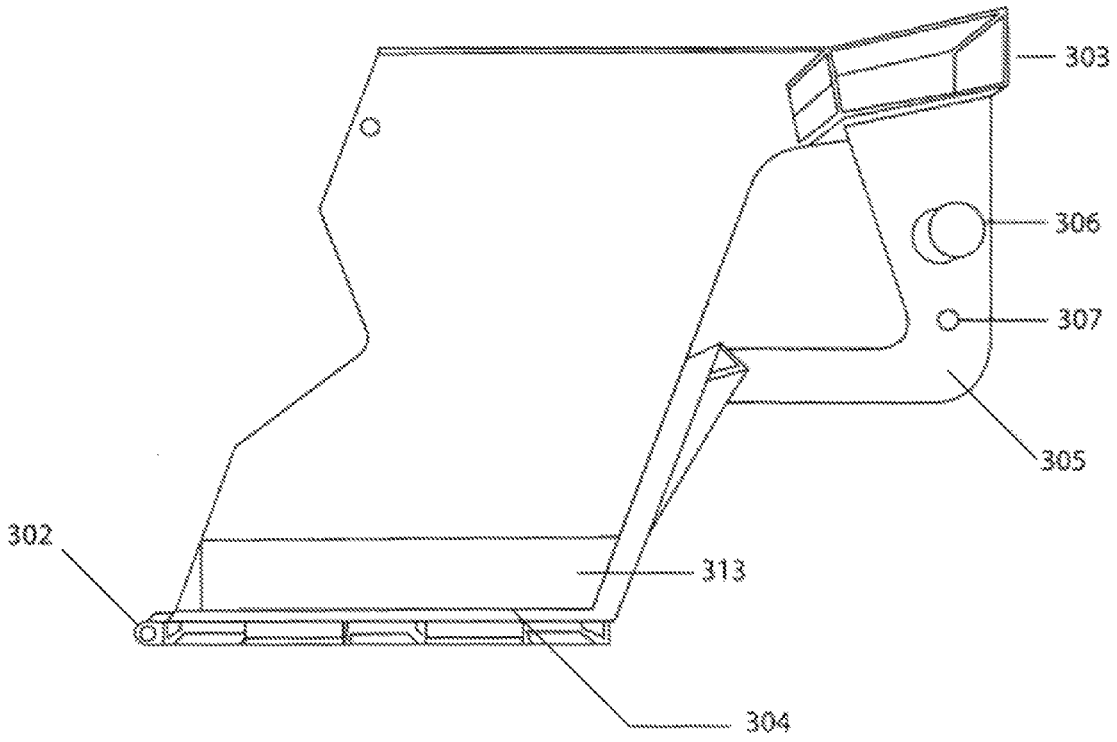
Figure 11C:
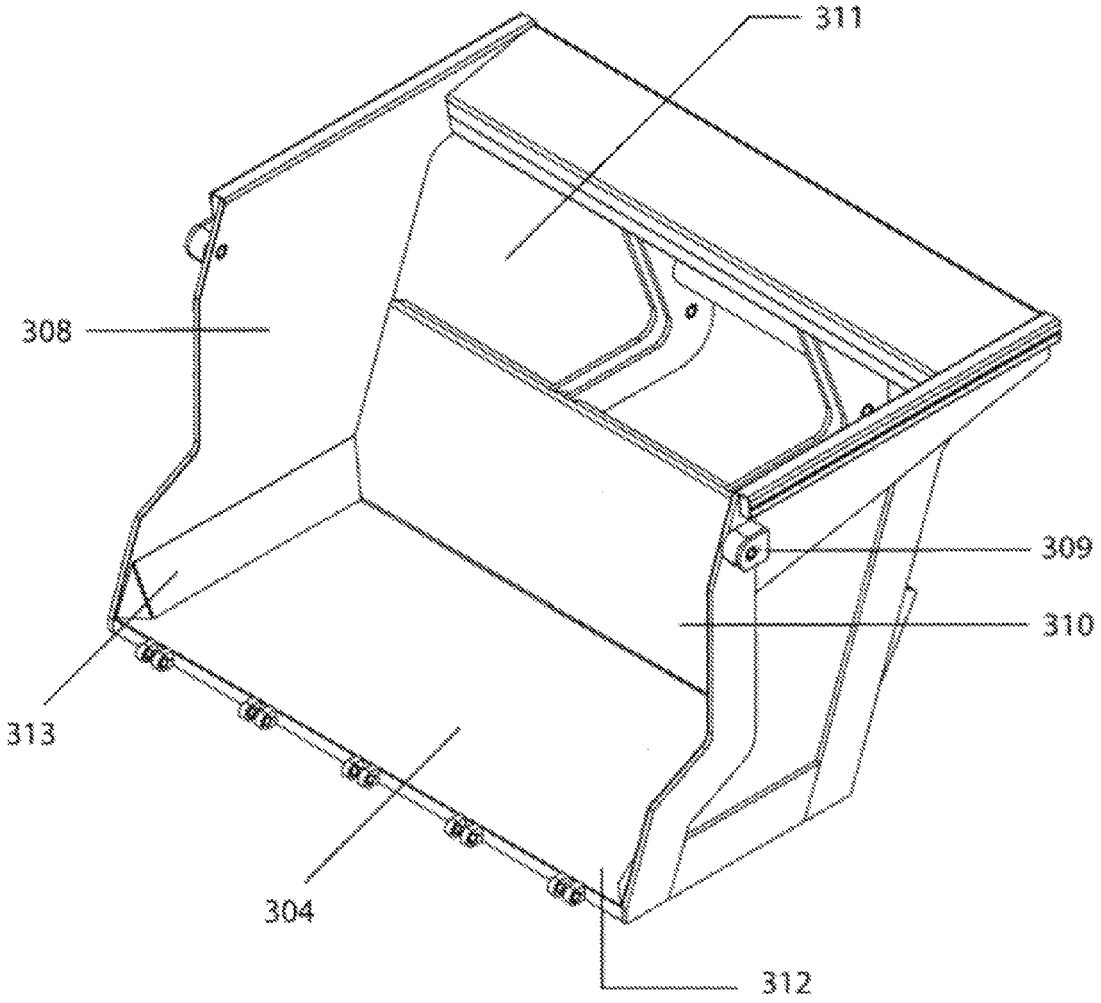
Figure 11D:
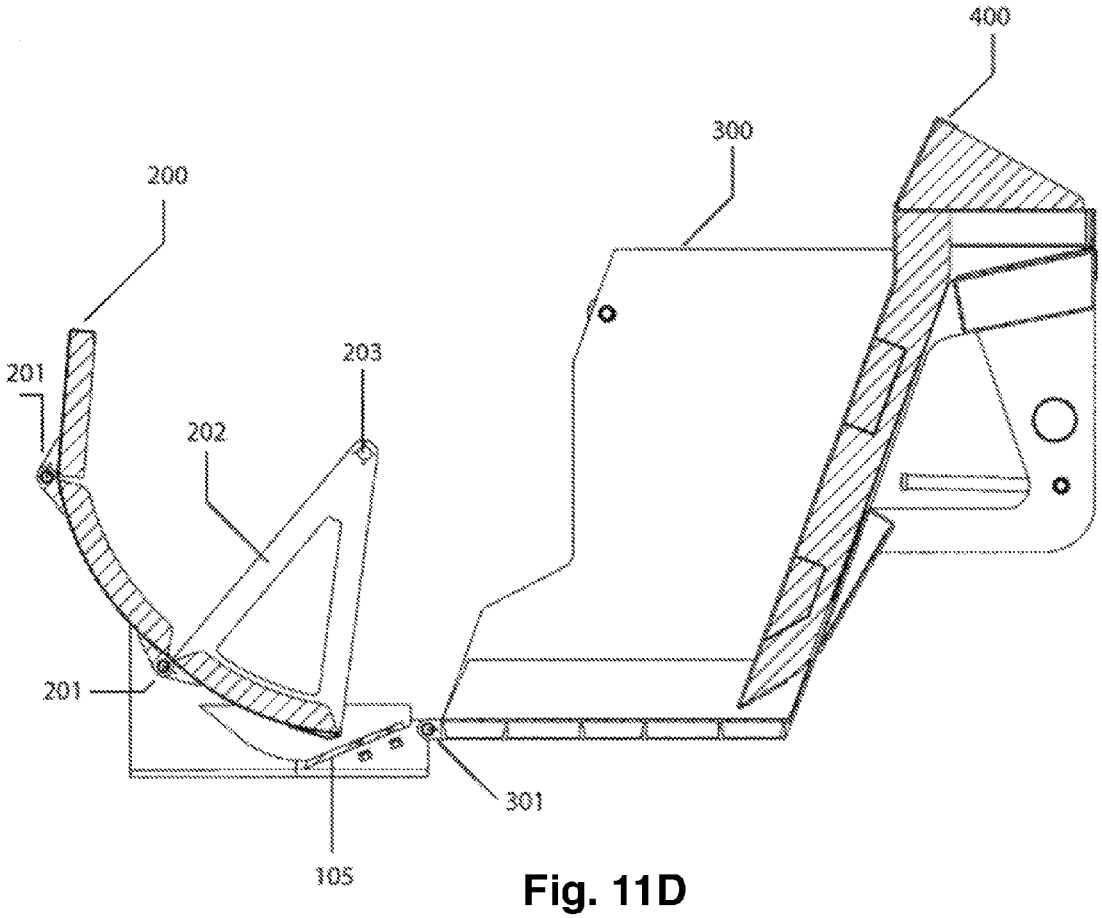

The hinged gate (200) is comprised of plates of semicircular configuration, in at least two sections, preferably three, wherein the sections are joined together by means of hinges (201) (see FIG. 6E, 10, 11D). The lower section joins a triangular element (202) which top vortex includes a bolt (203), which is dimensioned and configured to be inserted into the borehole (116) (see FIG. 6B). This borehole is located near the top edge of the walls (101) (see FIG. 6B). The borehole serves as a pivoting point for the triangular element (202). In an alternate embodiment, attaching the bolt (203) with the borehole (116) can be replaced by two boreholes joined by a bolt.

The hinged box (300) (see FIGS. 11A to 11D), is located inside the container (100) and sits on the reticulated floor (107); this box turns over the pair of bushings (301) that work in conjunction with bushings (111) of the support (105) of the blade, as described above. These bushings (301) are joined to a structural profile (302) by means of welding. In turn, the structural profile (302) is joined to a structure dimensioned and configured to be attached to the inside of the back of the container (100). A structural element in the form of rectangle (303) is located at the top of this hinged box. United with the structural element in the form of rectangle (303) and to the floor (304), there are supports (305) in the form of right angle joined by a bar (306). In the free end of the supports (305) holes (307) are provided to accommodate a bolt (not shown) that will serve as support for the pistons (PS3) (see FIGS. 4, 5 and 13) that would push the ejector (400). Parallel to the bushings (301), and at each end of the side walls (308) of the box, there are support elements (309) are provided for respective pistons (PS2) to rotate and allow tilting the hinged box. The point of support for this rotation is located in the support elements (113). The floor of the hinged box is flat and lies over the reticulated floor of the container (100).

In the lower and rear portion, attached to the floor (304) of the hinged box (300) there is a backing plate (310) at approximately half the height of the hinged box. This plate (310) supports part of the pressure exerted by the material on the ejector and also provides a structural reinforcement to the box. Through the space (311) located in the second half of the height of the scraper, the pistons (PS3) go through, supported by one of its ends in the hole (307), the other end is joined to the ejector (400). When at rest or at a retracted position (that is, there is no actuation), the ejector is supported on the support plate (310), on the floor of the box (304) and over the structural element (303). Beneath the floor of the box (304), a structural element of support (312) is positioned to strengthen the connection between the floor and walls of the box (see FIG. 11C).

A corner (313) is placed in the lower connections between the walls and the floor of the box that serve to prevent soil build-up on such connections and as an element of additional reinforcement for the sidewalls (308).

Figure 12C:
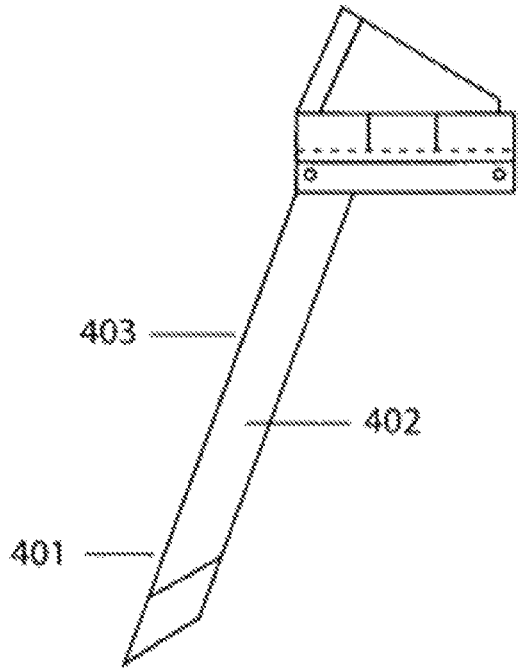
Figure 12D:
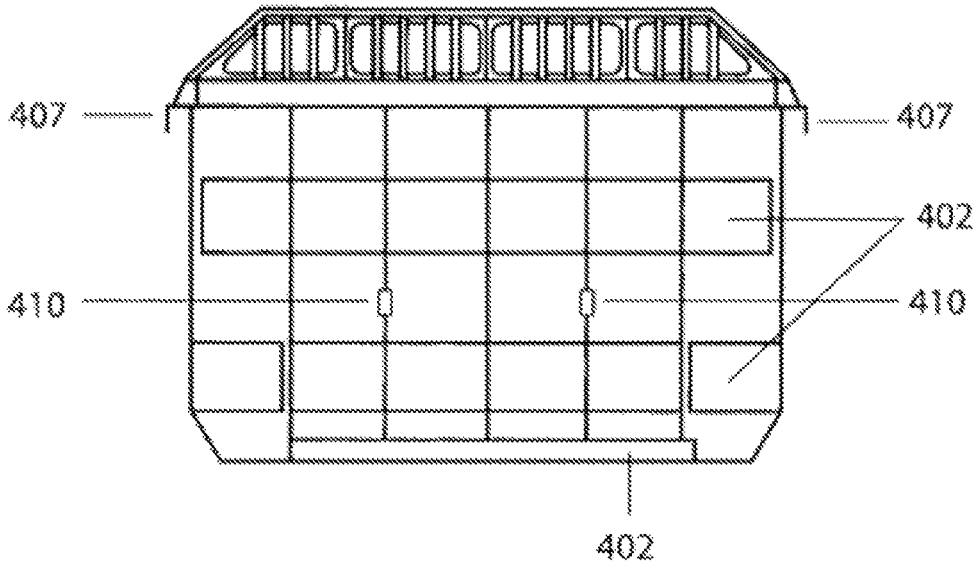
Figure 13:
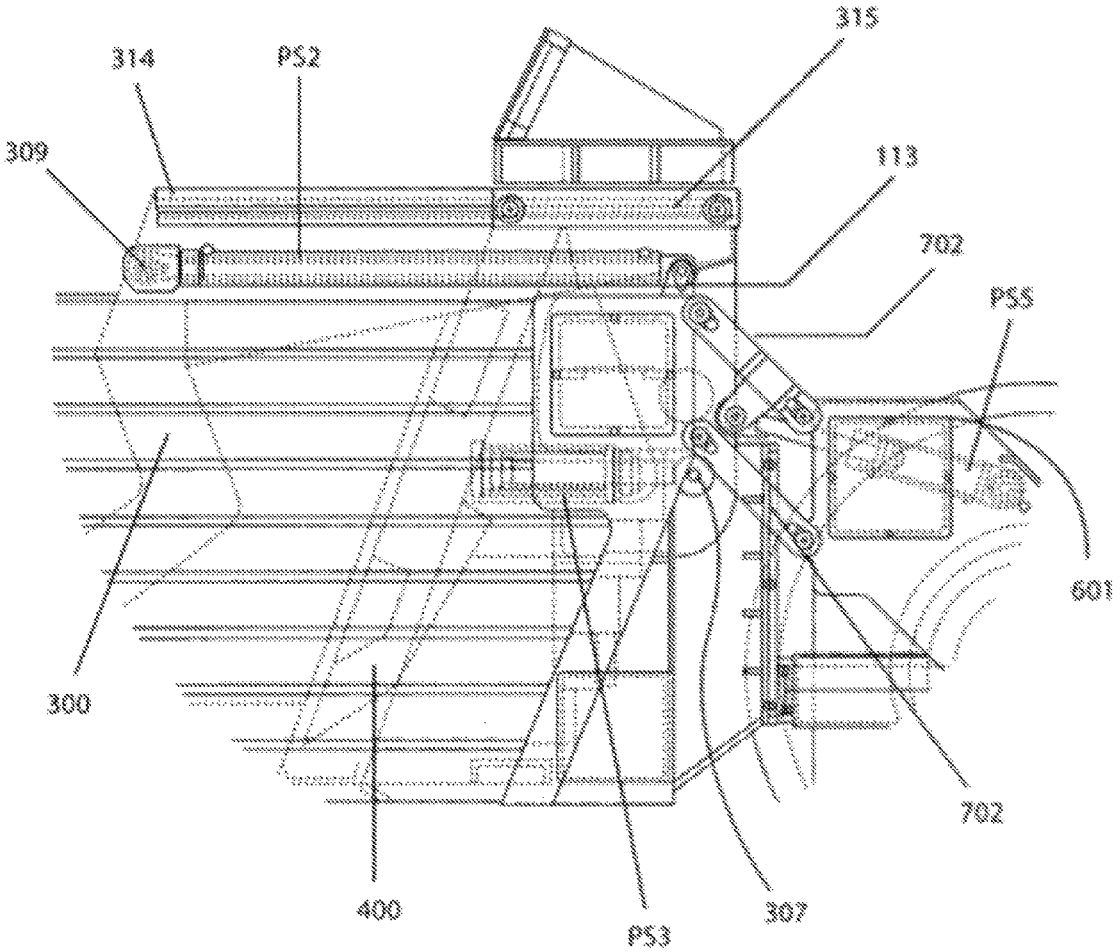
FIG. 13 is a detailed illustration showing the piston tilting the hinged box, the piston that actuates the ejector, the piston that actuates the rear parallelogram mechanism and the ejector slide.

Guides (314) located on the external face of the top part of the walls (308), are structural elements on which the ejector will slide, by means of a sliding mechanism (315) (see FIG. 13). The ejector's sliding system that include guides (314) and the sliding mechanism (315), consists of hollow elements that store two wheels (not shown), which have V-shaped tracks that slide at an angle mounted on the base of the internal face of the guides (314). The rotation axis of these wheels matches the borehole (408) located in the ejector (see FIGS. 12A to 12D).

With regard to FIGS. 12A to 12D, the ejector (400) is shown, which is located within the hinged box and that includes a pull plate (401), armed with structural profiles (402) and the steel plate (403). This steel plate will be responsible for directly pushing the material or land to be moved. The peripheral edge of the pull plate (401) corresponds with the shape of the peripheral back edge of the hinged box (300). The assembly of the plate (401) is such that it supports the mechanical stress to which it is subjected, as is obvious to any expert in the field. Attached to the plate (401) is the cover (404) which in turn joins the reticulated (405) through mounting holes (406). On the ends of the cover, the supports (407) for the sliding mechanism (315) are located. The supports (407) include the boreholes (408) that will serve to connect to the wheels already described. The structural component (409), which comprises a series of structural elements, is used to mechanically enhance to the supports (407) of the sliding mechanism (315) and to complement the cover (404) and the reticulated (405). The back of the ejector comprises two supports (410) for the ejector piston (PS3).

As explained above, the pistons (PS3) are joined to the ejector through the plates (401) (just on the bearings 410) as shown in FIGS. 12D and 13.

As shown in FIGS. 12A and 12C, the plate (401) is tilted at an angle of 95 to 120 degrees, preferably 110 degrees with respect to the floor' of the box (304). This angle is different from the angle (a) that is formed between the floor of the container (100) and the hinged box (300). This angle (a) has a minimum value of 0° and a maximum of approximately 45° with respect to the floor of the container (100).

As shown in FIGS. 12A and 12C, the plate (401) is tilted at an angle of 95 to 120 degrees, preferably 110 degrees with respect to the floor of the box (304). This angle is different from the angle (a) that is formed between the floor of the container (100) and the hinged box (300). This angle (a) has a minimum value of 0° and a maximum of approximately 45° with respect to the floor of the container (100).

With regard to FIGS. 7A to 7D, the pulling arm (500) is shown, which has among other purposes, pulling the scraper and to serve as a support base to raise the container or external box. Includes a tubular element (501) that runs along the width of the scraper. In the ends of the tubular element, the support groups (502A and 502B) are placed, which will be assembled to the support groups (109), by means of a parallelogram mechanism (701), (see FIG. 2). The side plates (503A) begin from the outer part of the plate (502B) (as shown in detail A in FIG. 7A), and together with the plates (503B), follow a generally V-shaped configuration (in top view) and ending in a straight portion (504) that includes the plates (505) to which the articulated element (800) will be joined that serves to join the scraper to the tractor. As detailed in FIG. 7A, in the center of the V there is a hollow area with a form that follows the contour of these plates (503A, 503B), following the contour in the form of V top caps (506) and lower caps (507) are placed.

Turning to the detail of FIG. 7A, it is shown that between the side plate (503A) and the group of supports (502A), there is a support (508) for a pushing piston (PS4) (see FIG. 5) of the parallelogram (701). It should be noted that to connect this piston (PS4) to the parallelogram, the piston must pass through the tubular element (501), for which corresponding bores (508A and 508B) have been provided. The other end of the piston is precisely supported on the parallelogram mechanism (701). This construction is repeated on the other side of the tubular element (501) as shown in FIGS. 7A. to 7D). The support groups (502A. and 502B) include ears with borehole for the attachment of parallelogram mechanism (701).

As shown in FIGS. 1 to 5, the wheel support (600) and the push element (106) are located in the back of the scraper. The constructive base of this support (600) includes a structural profile (601) to which plates (602A) and (602B) are placed perpendicular to it. Plates (602A) work in conjunction with the support supports (117) to join the support with wheels (600) to the container (100) through the parallelogram mechanism (702), at the same time it joins these two elements, the mechanism (702) may also move the container (100) upwards.

Parts of the plates (602A) include elements that point towards the support (600), such elements include boreholes with bushing (two per plate), these boreholes work in conjunction with boreholes provided in one of the ends of the parallelogram (702), this set of boreholes join pivotally there between by appropriate means. The opposite end of the parallelogram mechanism works the same way with the holes with bushing of the supports (117). The parallelogram mechanisms (701, 702) include a top part and a bottom part, wherein the top part is actuated by a piston (PS5 or PS4 in the case of the parallelogram 701) (see FIGS. 5 and 13) through an exiting element of the parallelogram placed at the bottom of the top element thereof. The lower end of the parallelogram mechanisms follows the movement of the top end. The other end of the piston (PS5 or PS4 as appropriate) joins the support (600), as shown in FIG. 13. Finally, at the interior part of the plates (602A) a support shaft (608) is located for the wheels (R) of the scraper.

Figure 8A:
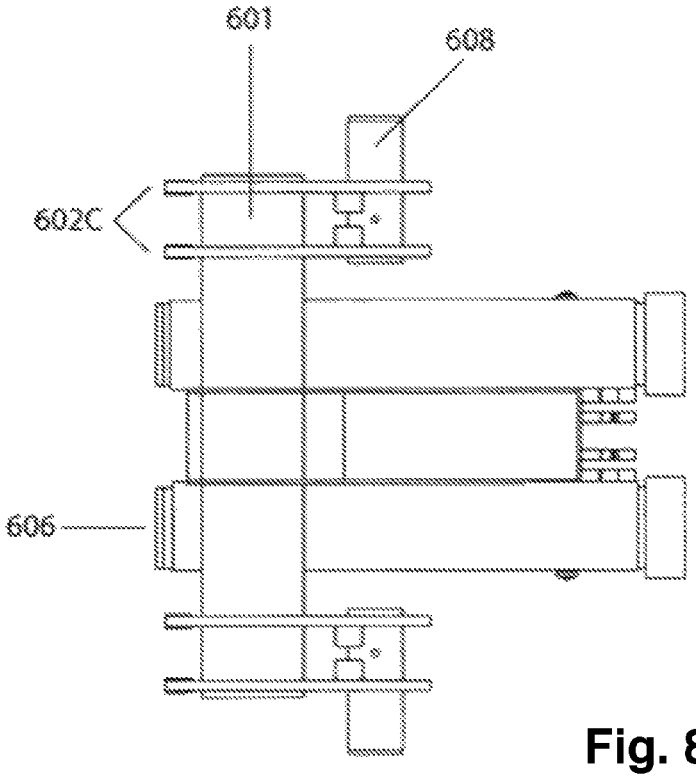
FIGS. 8A to 8E show a top view, a rear top perspective view, an elevated side view, an elevated rear view and a cut-away view of the pull element and wheel support.
Figure 8B:
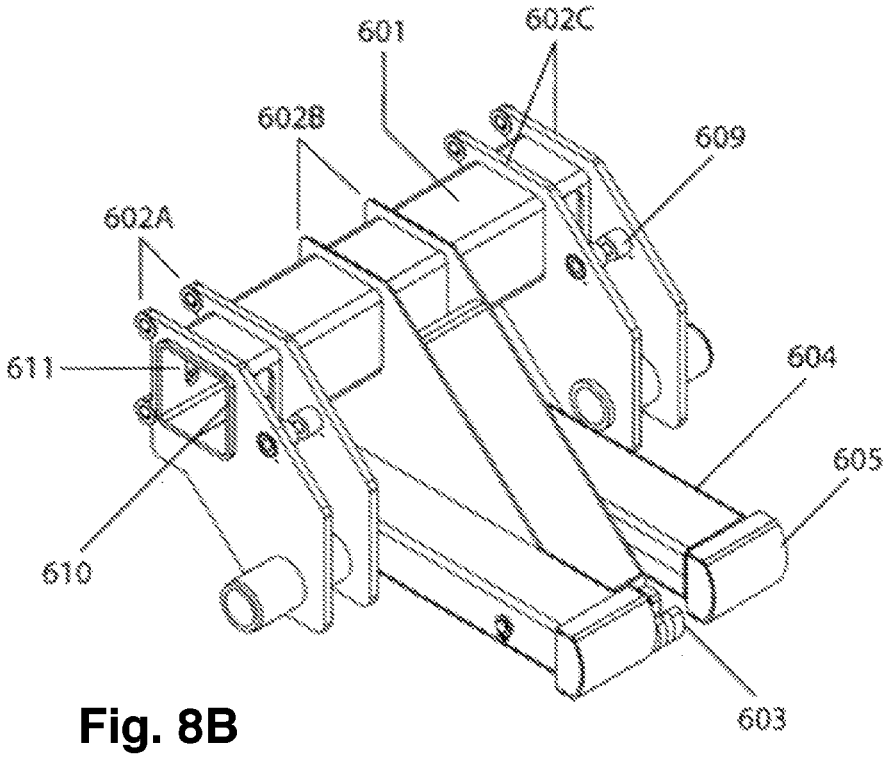
Figure 8C:
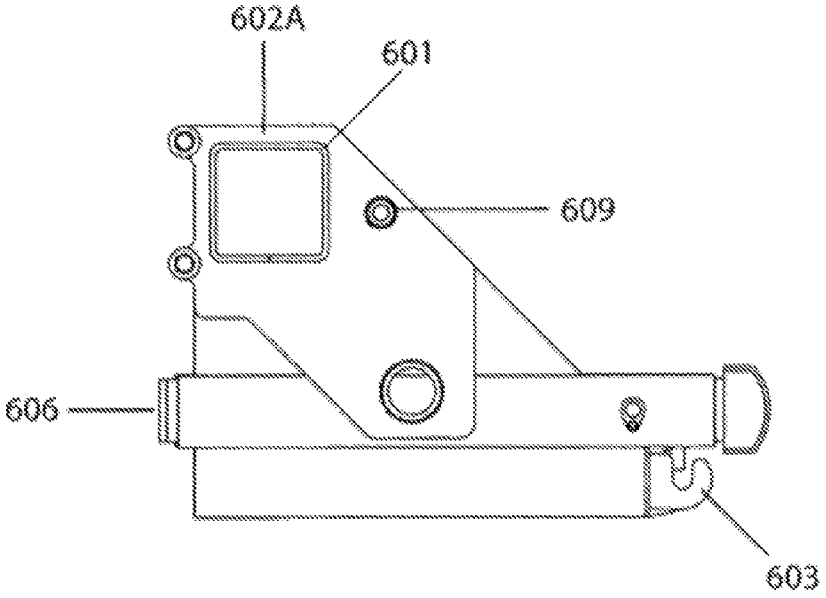
Figure 8D:
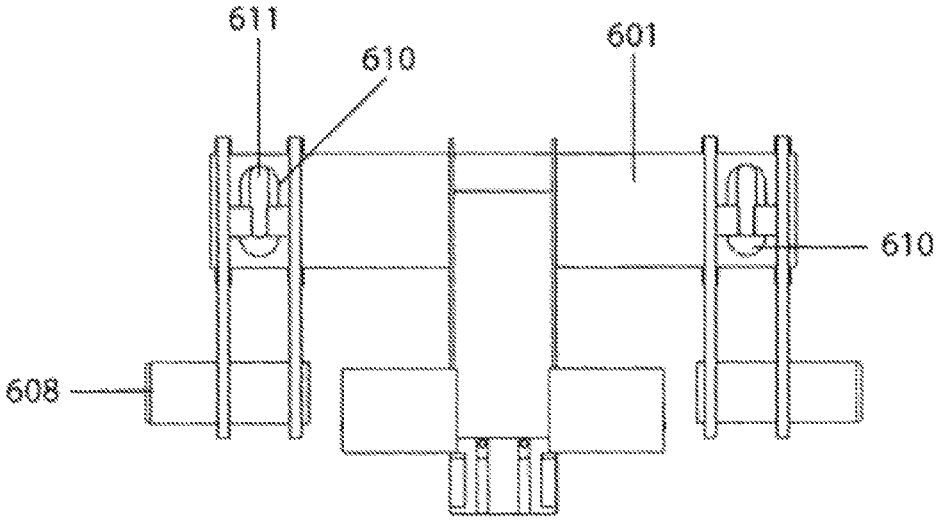

The support (600) includes a pair of push elements (604), which are used when the scraper gets stuck. This "stuck" phenomenon is very common and it is also common to loosen the scrapers by pushing them with a tractor or a similar vehicle. In the interior of the push element there is an outer sleeve (612) and an inner sleeve (613). In the outer sleeve there is a bolt with ear (614), which slips into the slot (607) of the inner sleeve (see FIG. 8E). This system is used only so that the inner sleeve does not leave the outer sleeve and to keep the system together. In other words, the inner sleeve has free longitudinal movement within the outer sleeve. The amplitude of this movement is slightly greater than the length between the shock element (606) and the push element (106) (FIG. 8A).

Plates (602B) have a different configuration than the plates (602A) and are positioned equidistant between each other with respect to the center of the profile (601) and have a generally triangular shape, where its rearmost end, i.e., near to the top elements (605), ends in a hook (603) (see FIGS. 8A to 8D and 9). This hook joins both plates (602B) by means of a third plate and transverse to the plates (602B), wherein the purpose of the hooks is to pull the scraper, in case of getting stuck. The hook is formed by a series of plates, united on its base. This hook (603) can be used to join other scrapers in tandem.

The material of construction of the scraper is, in general, structural grade carbon steel plate.

Figure 8E:
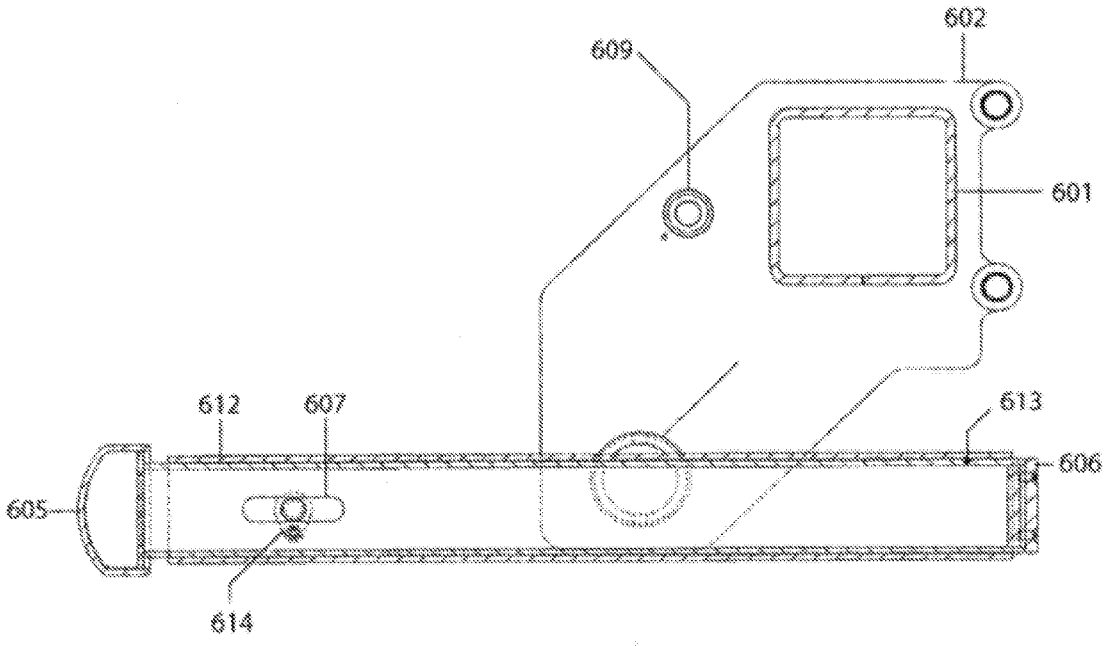
Figure 9:
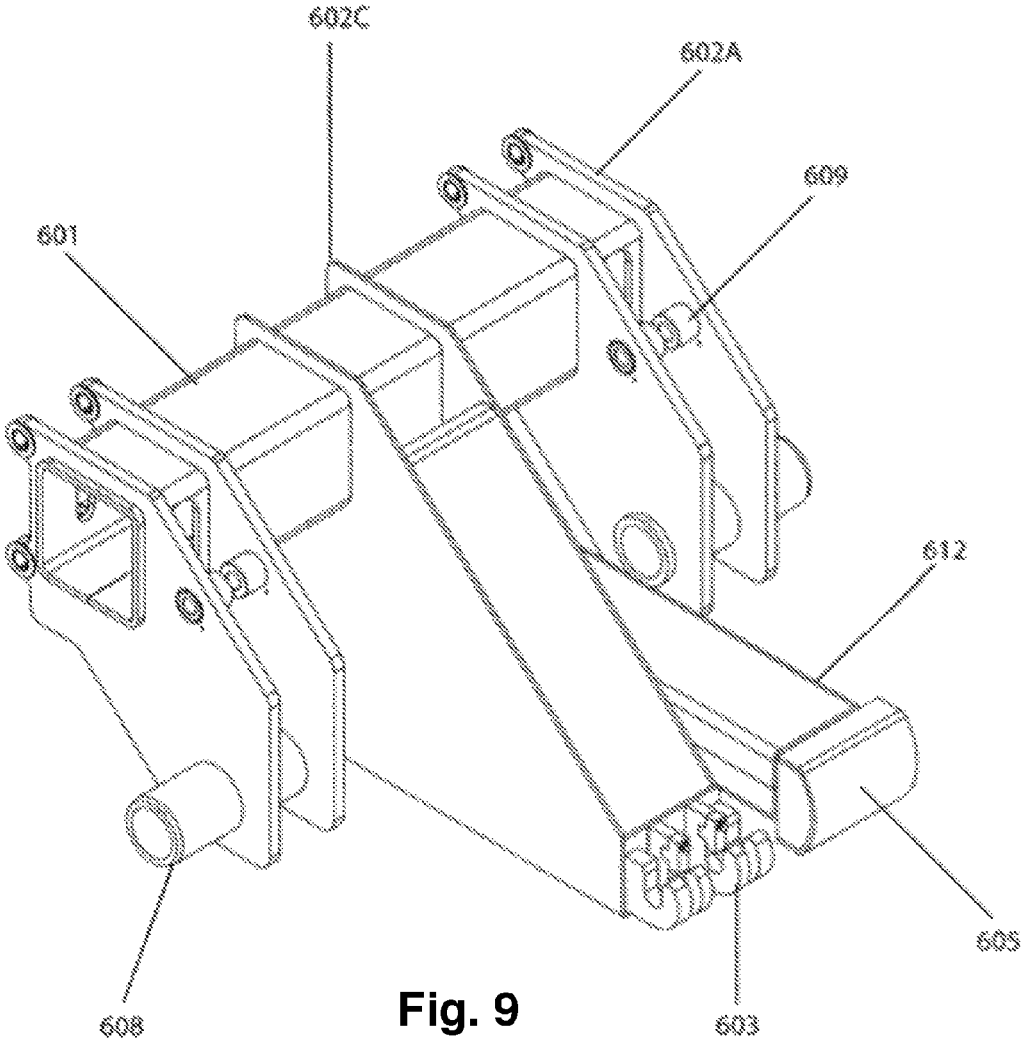
FIG. 9 is a similar view to the one in FIG. 8B, except that one of the tops has been eliminated to show in greater detail the coupling hooks.

FIG. 8E shows a cut-away view taken on the longitudinal axis of the support and is shown the form of the plates (602A) and the cut-away view of the pushing mechanism of one of the push elements (604). The top element (605) is a top configured to make contact with the push medium, such as a tractor (not shown).

The support (600) is attached to the container (100) by way of a parallelogram mechanism (702) similar to the parallelogram mechanism (701) that joins the pulling arm (500) with the container (100).

The two parallelogram mechanisms (701 and 702) are actuated at the same time when it is desired to evenly raise the container (100). It is also possible that the container is horizontally tilted, especially to give the cutting blade (112) an inclination. This inclination is achieved by activating or activating deactivating any of the mechanisms of parallelogram and with this tilting the container an angle varying from 0 to 45 degrees with the horizontal, preferably between 4 and 15 degrees.

The two parallelogram mechanisms (701 and 702) can be actuated at the same time when you it is desired to evenly raise the container (100), or at a different time if it is desired to raise the container at a certain angle with respect to the horizontal, and give the cutting blade (112) a tilt.

Figure 4:
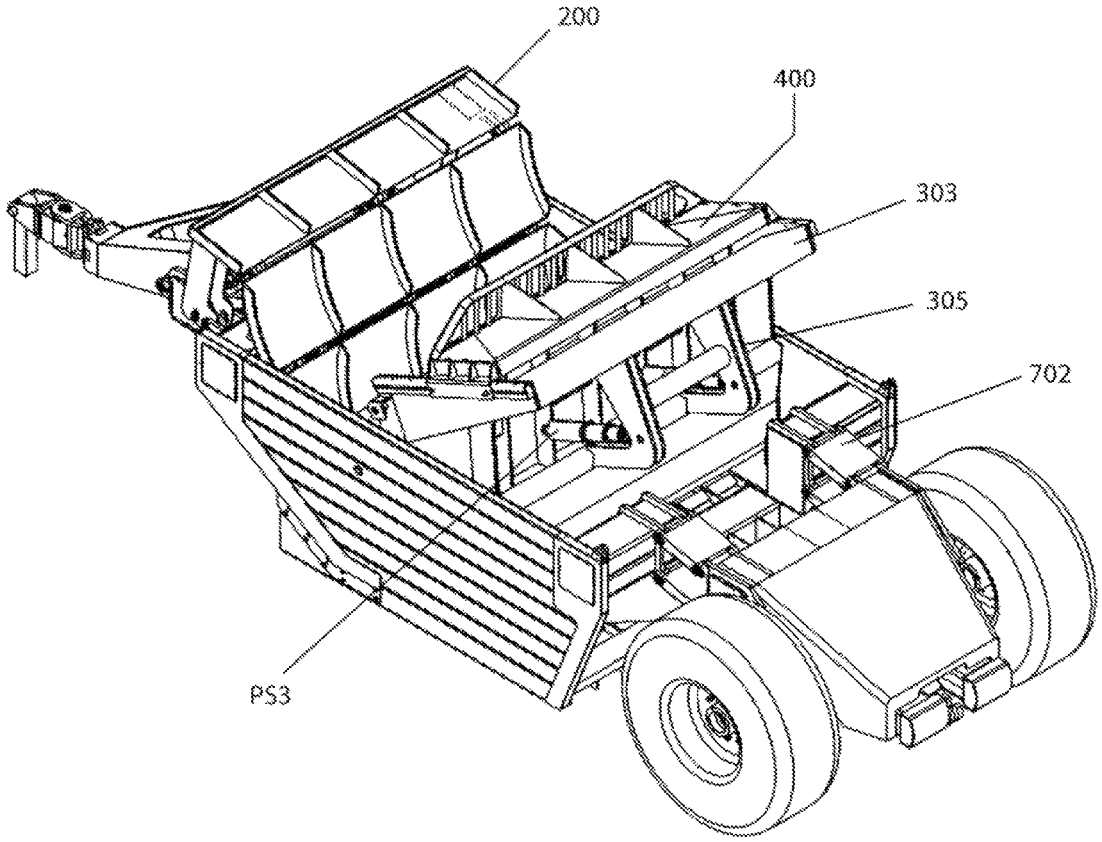
FIG. 4 is a perspective view of the scraper system with the hinged box in a elevated position, i.e. in unloading position by pivoting, with the gate open.

The parallelogram mechanism (702) is held by its first end to the holes in the plates (602A) (see FIGS. 8*a* and 8B) and the other end to the holes in the supports of support (117) located in the container (100) (see FIGS. 4, 6A and 6B).

The parallelogram mechanism (701) holds onto the holes in the plates (502A, 502B) (see FIGS. 2, 3, 7A to 7C among others) and onto the holes in the supports of support (109) located in the container (100) (see FIG. 6E).

At the lower end of the plates (602A) a borehole is provided where the arrow or shaft (608) will pass which will serve as a support to respective scraper wheels. Above these axis (608) and near the upper edge of the plates (602A), the supporting and swing bolts (609) are located for the piston (PS5, PS4) which passes through the tubular profile (601) and with this two perforations (610, 611) generally of elliptical configuration are provided. The body of the respective piston (PS5, PS4) passes through the drilled hole (610) and through the drilled hole (611) passes the rod thereof.

The pistons described herein are generally hydraulically actuated, although other types of activation means are possible.

As previously mentioned, the push elements (604) are means used for pushing or pulling the scraper. The pulling action is carried out by placing elements such as hooks that correspond in form with the already described hook (603). Pushing action is carried out by using the top elements (605) that are mechanically connected to the structural profile or inner sleeve (613), which is configured in a rectangular longitudinal section and an equally rectangular cross-section as well, although other configurations may be used. The sheath or outer sleeve (612) of the push element (604) has a form corresponding to the inner sleeve (613) so that it slides longitudinally within the outer sleeve. The outer sleeve has at its farthest end from the stop (605) the shock element (606) (FIG. 8A) that will transmit the pushing force from the top (605) to the container 100 in order to get the scraper out of a jam.

The previous configuration prevents the scraper from moving its pushing point. An inconvenience shown by the scrapers of the prior art is that they often get stuck at any stage of the working process. It is known that pushing points of current scrapers move together with the hinged box and therefore, when the scraper gets stuck with the hinged box in an elevated position, it is extremely difficult to push the scraper since its pushing point is equally elevated.

The scraper according to the present invention overcomes this drawback by maintaining the pushing point in a single level, regardless of the position of the container (100). This pushing point is represented by the top element (605).

The articulated element device (800) (see FIGS. 14 and 15) serves to couple the scraper to the tractor or to the means that will pull to the scraper or for coupling to another scraper.

It comprises three main parts: a first body (801) joined articulately to the center piece (802), which in turn articulately joins to a third hitch body (803). The connection between the first body and the center piece is made by means of a cylindrical arrow (804) having a first portion of a larger diameter (804A), a rod (804B), a keyway section (804C), a neck (804D) and finally the end (804E). The arrow (804) is introduced into the borehole (802A), supported on bushings (806). Perpendicular to this borehole (802A), the borehole (802B) is provided, which also includes two bushings (808A) used to accommodate the short bolts (808) that are secured to the body (801) by means of a threaded screw plate (808*b*) or any similar element, corresponding to the borehole (801E). The short bolt (808) is inserted through the borehole (801C) for coupling with bushings (808A) and is located on the plate (801A).

The threaded bolt (804) protrudes out of the central borehole of the articulated body (803), wherein this protrusion is the final end (804E) and the keyway section (804C) with its respective keyway is allocated within the body (803). This section (803) includes a notch in its central borehole that will contain the keyway (805), in order to allow the body (803) to rotate together with the arrow (804). To avoid that the articulated body becomes detached from the arrow (804), the neck section (804) is held in position by means of the crescent-shaped elements (803A), which in turn are held in position by means of fixing elements (803B) such as screws or rivets.

Finally, bolt (807) is placed between the boreholes transversal to the longitudinal axis of the scraper forward movement. This bolt is secured by means of conventional clamping elements (807*a*) such as screws.

A plate (801D) with perforations (801B) is positioned in the first body (801). These holes are used to modify the height of the articulated element device so that the height of the tractor and the scraper are matched. The plate (801F) joins the two plates (801A) and plate (801D), which is perpendicular to this plate (801F).

The arrangement of the device's pieces (800) allows a three-dimensional movement during its operation, with a minimum of components.

Figure 14:
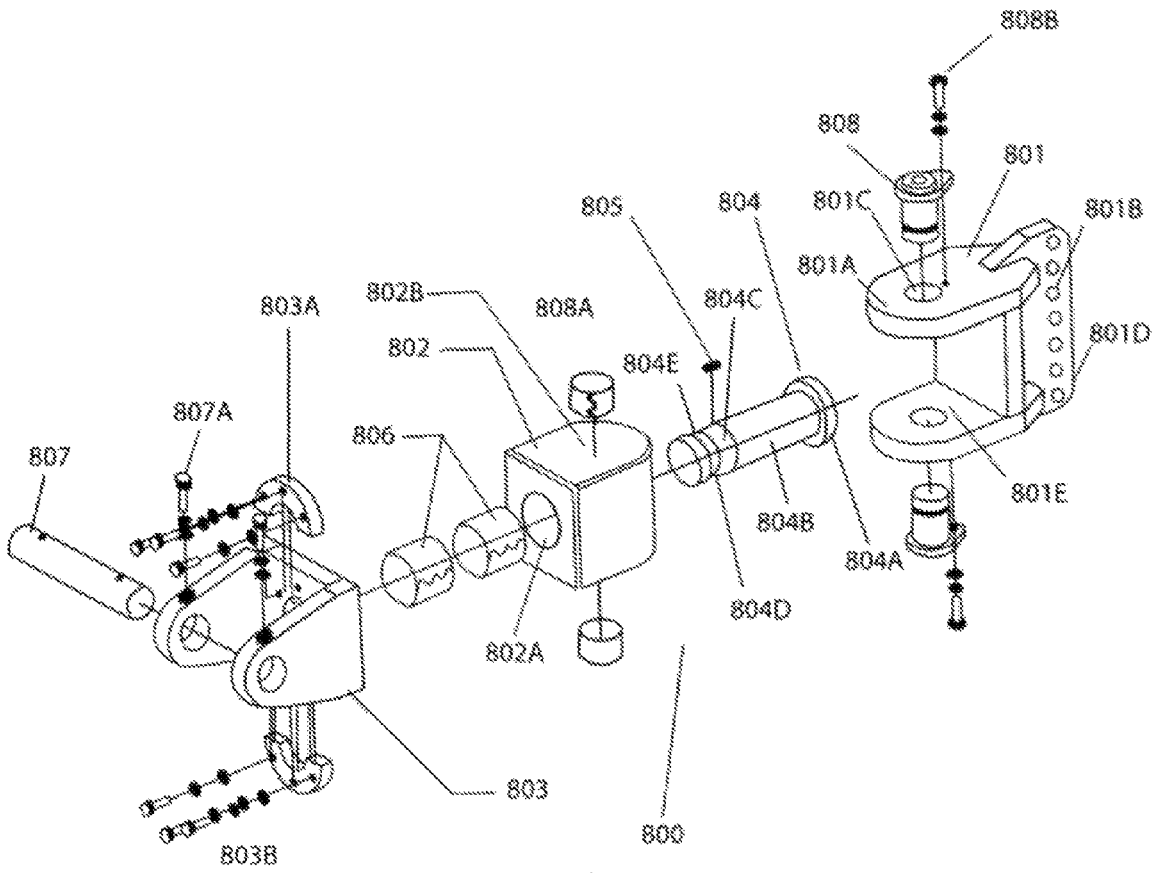
FIG. 14 is an exploded view of the coupling device.
Figure 15:
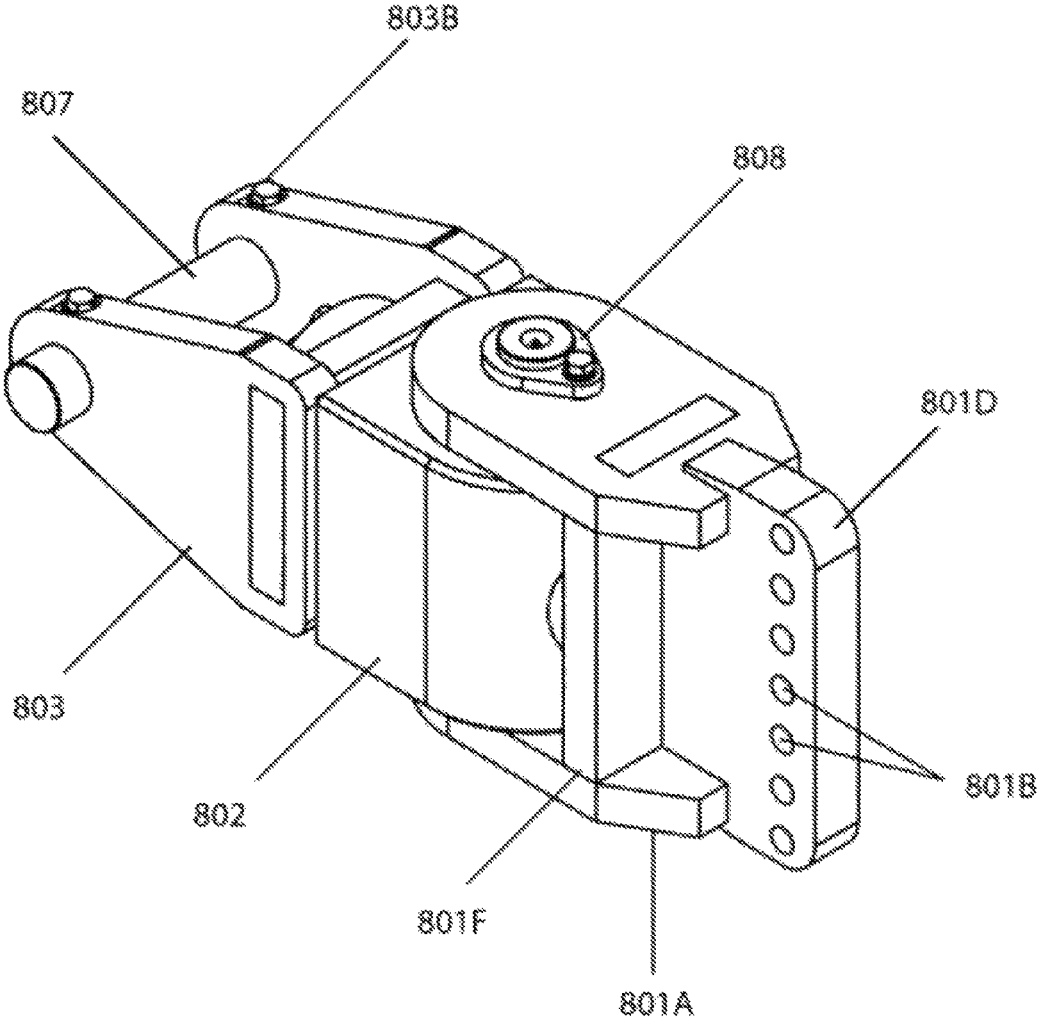
FIG. 15 is a perspective view of the coupling device joining the scraper to the tractor.

While individual components have been described, as is evident from the FIGS. 14 and 15, most of the components have upper and lower or left side and right side counterparts.

Process of Removing the Material

The scrapers are used to remove material (usually soil) from a point and transport it to a different place. To accomplish this (in accordance with prior art scrapers), the scraper is placed over the material to be removed and is lowered to a given point, wherein the tilting box is inclined along with the cutting blade and the scraper is moved forward to collect the material.

The cutting blade is tilted according to the type of material to be removed.

Once the collecting box is full of the material, it is leveled horizontally and the scraper is raised, wherein the content is withdrawn by one of the two known methods: tilting the collection box or by means of a pusher.

In the case of the present invention, the method of material removal has the following variants:

In the prior art, the blades are coupled to the hinged or collecting box which means that the box and the blade will have the same inclination and thus, the operation of the scraper will vary. In the present invention, the blade is coupled to the container or external box (100) and has an angle that will not vary, regardless of the position of the collection box, which has the benefit of requiring less power consumption and increasing the amount of material removed per work day. This is accomplished since the angle provided to the blade is the optimum angle for cutting the soil, thus achieving less power consumption, in such a way that this angle is not change whether the container is raised or lowered, so that the operator controls the depth of cut and in any case, the power consumption will be always optimal. In other words, the optimum cutting angle is obtained by the parallelogram mechanisms that prevent the cutting blade from changing its angle of cutting, making the cut more efficient.

Another important difference is that the general configuration of the scraper of the present invention comprises three main parts:

a frontal part that includes:
a coupling element with the tractor and a pulling arm;
a central part that includes:
a container, a hinged box, an ejector and a hinged gate and finally;
a rear part that includes:
a wheels support and a pushing element.

The frontal part joins mechanically to the central part only by means of a parallelogram mechanism and the central part joins mechanically to the rear part only by means of a parallelogram mechanism. Where the mechanisms of a parallelogram are equal or different but in the preferred embodiment are equal.

A third and no less important difference is the fact that the ejection of the material is accomplished by means of one or both methods known in the art and such dual configuration was not provided in a single scraper, until the present invention. Actually, the present invention provides a scraper that can eject the material by tilting the material collection box referred herein as a hinged box and/or ejecting the material through the ejector included in the container or outer box.

A fourth difference between the scrapers of the prior art is the fact that the container or external box can be raised vertically through the parallelogram mechanisms. This raise can be parallel to the horizontal or have a degree of inclination.

The following describes the method of soil movement of the scraper according to the present invention.

a) Moving the scraper with the container (100) in a raised position towards the area of the material to be removed, b) Activating the pistons (PS4 and PS5) for lowering the container to its working position, c) Activating and/or deactivating the pistons (PS4 and PS5) for tilting the container to its optimal cutting position, d) Moving the scraper to load the material, e) Activating the pistons (PS4 and PS5) in order to raise the container with the removed material, f) Transporting the scraper to the place where the material will be unloaded, g) Opening the hinged gate by actuating the pistons (PS1) to allow unloading the material, h) Unloading the material, i) Repeating the process of steps (a) to (h).

Wherein activation of the pistons in stages (b) and (f) is performed so that the container is raised almost parallel to the horizontal line and wherein both sets of pistons are actuated at the same time.

Wherein unloading the material on step h) can be done by one of three options:

h1) raising the hinged gate (200) by actuating the pistons (PS1), and tilting the hinged box (300) by actuating the pistons (PS2) allowing the material to fall by gravity;

h2) raising the hinged gate (200) by actuating the pistons (PS1), actuating the pistons (PS3) to push the ejector and ejecting the collected material; or h3) raising the hinged gate (200), tilting the hinged box (300) by actuating the pistons (PS2) and actuating the pistons (PS3) to push the ejector and eject the collected material allowing the material to fall by gravity and by the push of the ejector.

The scraper of the present invention has been described as such a way that a person with average knowledge in the art can understand the invention and at a given moment can reproduce it at industrial level. It also submitted that this invention is novel and its development involves an inventive step that meets the worldwide criteria of patentability.

It is requested that equivalents of devices and building elements be included when considered obvious to a person with average knowledge in the art, for example, some of the profiles can be circular in the cross section, the reinforcement elements can be of different sizes, location and shape or even modifications can be made in the way of connecting other than welding. It is requested that the scope of the present invention be limited only by the appended claims and their interpretation based on this description and the appended figures that are part of this application.

The invention claimed is:

1. A scraper with dual downloading mechanism comprising:

a container enclosing a hinged gate located at a front part of said container, a hinged box located at a rear part of said container, and an ejector located at said rear part of the container and inside said hinged box;

a first piston arrangement coupled to said hinged gate for selectively opening and closing said hinged gate;

a second piston arrangement coupled to said hinged box for selectively tilting said hinged box;

a third piston arrangement coupled to said ejector for selectively pulling or pushing said ejector;

a forth piston arrangement coupled to the front part of said container for selectively raising or lowering said front part of the container; and a fifth piston arrangement coupled to the rear part of said container for selectively raising or lowering said rear part of the container.

2. The scraper according to claim 1, further comprising a pull arm having an end coupled to the front part of said container via a first parallelogram arrangement.

3. The scraper according to claim 2, further comprising a wheel support with a thrust element coupled to the rear part of said container via a second parallelogram arrangement.

4. The scraper according to claim 2, further comprising an articulated element coupled to another end of said pull arm.

5. The scraper according to claim 1, wherein said container includes a reticulated floor comprising a mesh of floorings.

6. The scraper according to claim 5, wherein said reticulated floor supports the weight of said hinged box.

7. The scraper according to claim 1, further comprising a cutting blade located at the bottom part of said container.

8. The scraper according to claim 5, wherein said reticulated floor comprises a cutting blade.

9. The scraper according to claim 1, further comprising side cutting blades located at a bottom part of sidewalls of the container.

10. The scraper according to claim 1, wherein said hinged gate comprises a plurality of plates having semicircular configuration joined together by means of hinges.

11. The scraper according to claim 10, further comprising a triangular element having a first end coupled to a sidewall and configured as a pivot point for said hinged gate and a second end coupled to said hinged gate.

12. The scraper according to claim 1, wherein said ejector slides on guides provided on said hinged box.

13. The scraper according to claim 1, wherein said third piston arrangement is coupled to a back surface of said ejector.

14. The scraper according to claim 1, wherein the hinged box is selectively tilted at angle of from 0° to about 45° with respect to a floor of the container.

15. The scraper according to claim 3, wherein said first parallelogram arrangement comprises a first left parallelogram mechanism coupled between a left portion of said pull arm end and a left portion of said front part of the container and a first right parallelogram mechanism coupled between a right portion of said pull arm end and a right portion of said front part of the container; and said second parallelogram arrangement comprises a second left parallelogram mechanism coupled between a left portion of said wheel support and a left portion of said rear part of the container and a second right parallelogram mechanism coupled between a right portion of said wheel support and a right portion of said rear part of the container.

16. The scraper according to claim 3, wherein the first and second parallelogram arrangements are actuated at the same time to evenly raise the container with respect to the horizontal or individually to raise the container at an angle with respect to the horizontal.

17. The scraper according to claim 16, wherein said angle varies from 0° to 45° degrees with respect to the horizontal.

18. The scraper according to claim 16, wherein said angle varies from 4° to 15° degrees with respect to the horizontal.

19. The scraper according to claim 1, wherein said first, second, third, fourth and fifth piston arrangements are hydraulically actuated.

20. A process to remove material from a land using the scraper of the claim 1, the process comprising:

a) positioning the scraper with the container in a raised position in the area with the material to be removed;

b) selectively actuating said forth and fifth piston arrangement for lowering the container to a working position;

c) moving the scraper in order to load the material;

d) selectively actuating said forth and fifth piston arrangement for raising the container with the material removed;

e) moving the scraper to a place of material unloading; and f) actuating said first piston arrangement to open the hinged gate.

21. The process of claim 20, further comprising:

g) actuating the second piston arrangement for tilting the hinged box thus allowing the material to fall outside the container by gravity.

22. The process of claim 20, further comprising:

g) actuating the third piston arrangement for pushing the ejector effectively ejecting the material out of the container.

23. The process of claim 20, further comprising:

g) actuating the second piston arrangement for tilting the hinged box; and h) actuating the third piston arrangement for pushing the ejector, wherein the material leaves the container by the combined effect of the ejector movement and gravity.

* * * * *